US011580889B2

(12) United States Patent
Lee et al.

(10) Patent No.: US 11,580,889 B2
(45) Date of Patent: Feb. 14, 2023

(54) ELECTRONIC DEVICE, METHOD, AND COMPUTER-READABLE MEDIUM FOR DISPLAYING SCREEN IN DEFORMABLE DISPLAY PANEL

(71) Applicant: Samsung Electronics Co., Ltd., Suwon-si (KR)

(72) Inventors: Seungheon Lee, Suwon-si (KR); Sehoon Kim, Suwon-si (KR); Wonhee Choe, Suwon-si (KR); Hoyoung Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/478,335

(22) Filed: Sep. 17, 2021

(65) Prior Publication Data

US 2022/0005392 A1 Jan. 6, 2022

Related U.S. Application Data

(63) Continuation of application No. PCT/KR2020/003718, filed on Mar. 18, 2020.

(30) Foreign Application Priority Data

Mar. 19, 2019 (KR) ..... 10-2019-0031315

(51) Int. Cl.
*G09G 3/00* (2006.01)
*G09G 5/373* (2006.01)

(52) U.S. Cl.
CPC ..... *G09G 3/035* (2020.08); *G09G 5/373* (2013.01); *G09G 2310/08* (2013.01); *G09G 2360/128* (2013.01); *G09G 2370/00* (2013.01)

(58) Field of Classification Search
CPC combination set(s) only.
See application file for complete search history.

(56) References Cited

U.S. PATENT DOCUMENTS 7,327,341 B2 2/2008 Toriumi et al.
2002/0000995 A1* 1/2002 Sawada ..... G09G 1/165 345/620

(Continued)

FOREIGN PATENT DOCUMENTS

JP 2004-341149 A 12/2004
JP 2006-343511 A 12/2006

(Continued)

*Primary Examiner* — Shaheda A Abdin
(74) *Attorney, Agent, or Firm* — Jefferson IP Law, LLP

(57) ABSTRACT

An electronic device is provided. The electronic device includes a deformable display panel, a sensor, a display driving circuit operatively coupled to the deformable display panel and the sensor, and comprising a graphical random access memory (GRAM), and a processor operatively coupled to the display driving circuit and the sensor, wherein the display driving circuit can be configured to, while the size of a displayable area of the deformable display panel is changed, store, in the GRAM, data for displaying an image of a first size received from the processor, receive, from the sensor, a signal for indicating that the size of the displayable area is a second size smaller than the first size, after the data is stored, and scan part of the data in response to the reception of the signal, thereby displaying an image of the second size through the deformable display panel.

12 Claims, 16 Drawing Sheets

(56) References Cited

U.S. PATENT DOCUMENTS

| | | | | |
|---|---|---|---|---|
| 2006/0114219 | A1* | 6/2006 | Park | G09G 3/3413 345/102 |
| 2006/0290688 | A1 | 12/2006 | Chae et al. | |
| 2009/0115771 | A1 | 5/2009 | Washio | |
| 2011/0254709 | A1* | 10/2011 | Ciesla | G06F 3/016 341/20 |
| 2013/0265221 | A1* | 10/2013 | Lee | H04N 21/41265 345/156 |
| 2013/0342439 | A1 | 12/2013 | Kwack et al. | |
| 2016/0307545 | A1* | 10/2016 | Lee | G09G 5/346 |
| 2016/0344988 | A1* | 11/2016 | Kase | H05K 13/00 |
| 2017/0091340 | A1 | 3/2017 | Yoon et al. | |
| 2017/0140737 | A1 | 5/2017 | Cho et al. | |
| 2020/0142522 | A1 | 5/2020 | Hong et al. | |

FOREIGN PATENT DOCUMENTS

| | | | |
|---|---|---|---|
| KR | 10-0608766 | B1 | 8/2006 |
| KR | 10-1420330 | B1 | 7/2014 |
| KR | 10-2017-0014886 | A | 2/2017 |
| KR | 10-2017-0036317 | A | 4/2017 |
| KR | 10-2018-0043433 | A | 4/2018 |

* cited by examiner

ELECTRONIC DEVICE, METHOD, AND COMPUTER-READABLE MEDIUM FOR DISPLAYING SCREEN IN DEFORMABLE DISPLAY PANEL

CROSS-REFERENCE TO RELATED APPLICATION(S)

This application is a continuation application, claiming priority under § 365(c), of an International application No. PCT/KR2020/003718, filed on Mar. 18, 2020, which is based on and claims the benefit of a Korean patent application number 10-2019-0031315, filed on Mar. 19, 2019, in the Korean Intellectual Property Office, the disclosure of which is incorporated by reference herein in its entirety.

BACKGROUND

1. Field

The disclosure relates to an electronic device, a method, and a computer-readable medium for displaying a screen within a deformable display panel.

2. Description of Related Art

With the development of technology, electronic devices with deformable display panels, such as foldable display panels, rollable display panels, extendable display panels, or flexible display panels are being developed.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an electronic device that may include a display panel in order to provide information. The display panel may be portable, usable, or deformable. The size of a displayable area of the deformable display panel within the electronic device may vary depending on a state of the electronic device, and thus the size of a screen displayed through the deformable display panel may also vary.

Additional aspects will be set forth in part in the description which follows and, in part, will be apparent from the description, or may be learned by practice of the presented embodiments.

In accordance with an aspect of the disclosure, an electronic device is provided. The electronic device includes a deformable display panel, a sensor, a display driving circuit operatively connected to the deformable display panel and the sensor and including a Graphical Random Access Memory (GRAM), and a processor operatively connected to the display driving circuit and the sensor, and the display driving circuit may be configured to store data for displaying an image having a first size received from the processor in the GRAM while a size of a displayable area of the deformable display panel is changed, receive a signal indicating that the size of the displayable area is a second size smaller than the first size after storing the data, and display the image having the second size through the deformable display panel by scanning some pieces of the data in response to reception of the signal.

In accordance with another aspect of the disclosure, an electronic device is provided. The electronic device includes a deformable display panel, a sensor, a display driving circuit operatively connected to the deformable display panel and the sensor and including a Graphical Random Access Memory (GRAM), and a processor operatively connected to the display driving circuit and the sensor, and the display driving circuit may be configured to receive a signal for identifying a displayable area within an entire area of the deformable display panel from the sensor, acquire data for displaying, in response to identification that the displayable area includes all lines of a first set among a plurality of sets included in the entire area, an image on lines of the first set and transmit the data to the display driving circuit in order to record the data in the GRAM, and forgo acquiring of the data in response to identification that the displayable area includes some of the lines of the first set.

In accordance with another aspect of the disclosure, an execution method of an electronic device including a deformable display panel, a sensor, a display driving circuit including a Graphical Random Access Memory (GRAM), and a processor is provided. The method includes storing data for displaying an image having a first size received from the processor in the GRAM while a size of a displayable area of the deformable display panel is changed, receiving a signal indicating that the size of the displayable area is a second size smaller than the first size after storing the data, and displaying the image having the second size through the deformable display panel by scanning some pieces of the data in response to reception of the signal.

In accordance with another aspect of the disclosure an execution method of an electronic device including a deformable display panel, a sensor, a display driving circuit including a Graphical Random Access Memory (GRAM), and a processor is provided. The method includes receiving a signal for identifying a displayable area within an entire area of the deformable display panel from the sensor, acquiring data for displaying, in response to identification that the displayable area includes all lines of a first set among a plurality of sets included in the entire area, an image on lines of the first set and transmitting the data to the display driving circuit in order to record the data in the GRAM, and forgoing acquiring of the data in response to identification that the displayable area includes some of the lines of the first set.

A non-transitory computer-readable storage medium according to various embodiments may store one or more programs having instructions causing, when executed by one or more processors of an electronic device including a deformable display panel, a sensor, and a display driving circuit including a Graphical Random Access Memory (GRAM), the electronic device to store data for displaying an image having a first size received from the processor in the GRAM while a size of a displayable area of the deformable display panel is changed, receive a signal indicating that the size of the displayable area is a second size smaller than the first size after storing the data, and display the image having the second size through the deformable display panel by scanning some pieces of the data in response to reception of the signal.

A non-transitory computer-readable storage medium according to various embodiments may store one or more programs having instructions causing, when executed by one or more processors of an electronic device including a deformable display panel, a sensor, and a display driving circuit including a Graphical Random Access Memory (GRAM), the electronic device to receive a signal for identifying a displayable area within an entire area of the deformable display panel from the sensor, acquire data for displaying, in response to identification that the displayable area includes all lines of a first set among a plurality of sets included in the entire area, an image on lines of the first set and transmit the data to the display driving circuit in order to record the data in the GRAM, and forgo acquiring of the data in response to identification that the displayable area includes some of the lines of the first set.

An electronic device, a method, and a computer-readable medium based on a situation according to various embodiments can improve efficiency of resources for displaying a screen within a deformable display panel.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
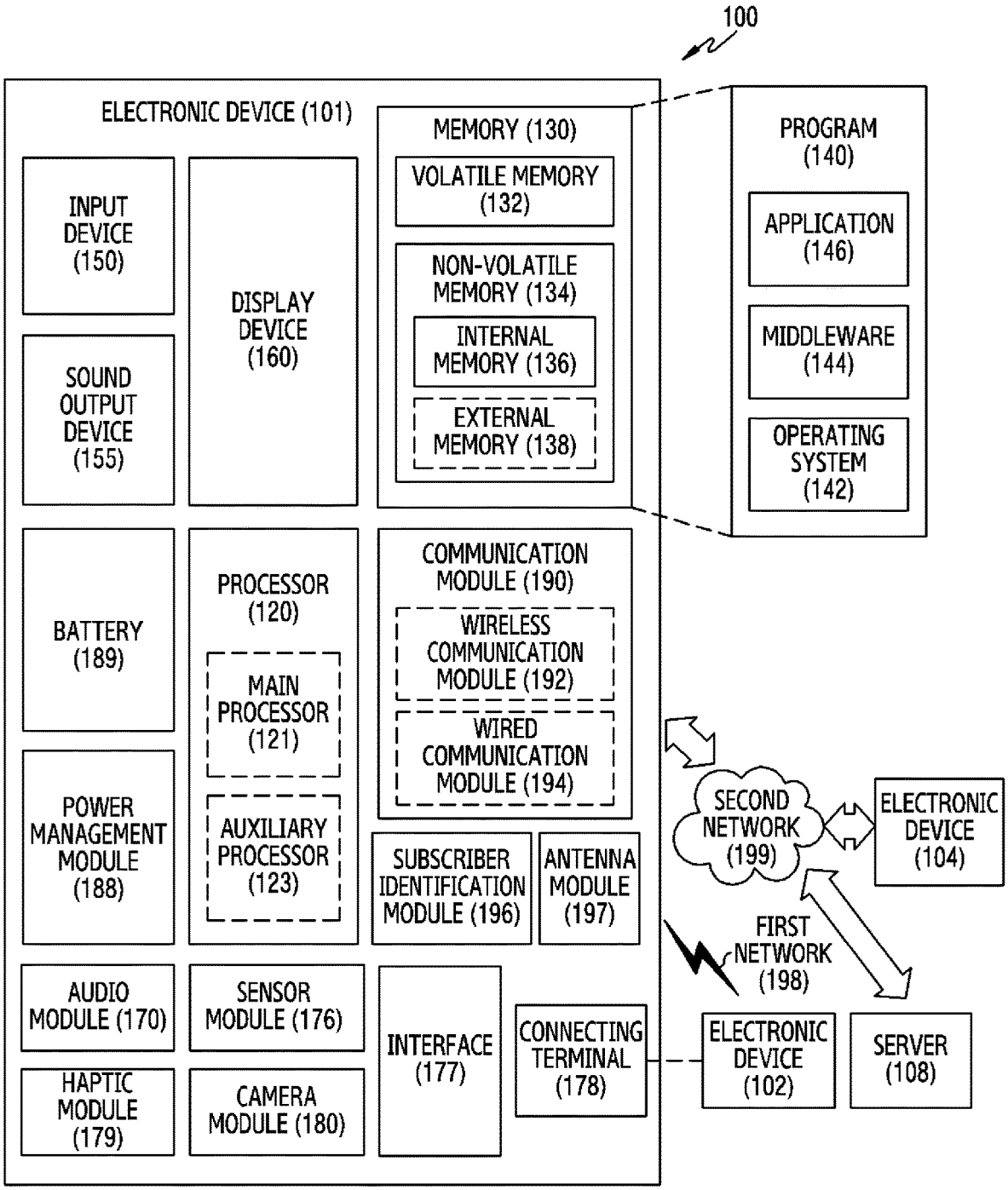
FIG. 1 is a block diagram illustrating an electronic device within a network environment according to an embodiment of the disclosure.

FIG. 1 is a block diagram illustrating an electronic device 101 in a network environment 100 according to an embodiment.

Referring to FIG. 1, an electronic device 101 in a network environment 100 may communicate with an external electronic device 102 via a first network 198 (e.g., a short-range wireless communication network), or an external electronic device 104 or a server 108 via a second network 199 (e.g., a long-range wireless communication network). According to an embodiment of the disclosure, the electronic device 101 may communicate with the external electronic device 104 via the server 108. According to an embodiment of the disclosure, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments of the disclosure, at least one (e.g., the display device 160 or the camera module 180) of the components may be omitted from the electronic device 101, or one or more other components may be added in the electronic device 101. In some embodiments of the disclosure, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment of the disclosure, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment of the disclosure, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment of the disclosure, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thererto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment of the disclosure, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment of the disclosure, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment of the disclosure, the audio module 170 may obtain the sound via the input device 150, or output the sound via the sound output device 155 or a headphone of an external electronic device (e.g., an external electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment of the disclosure, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the external electronic device 102) directly (e.g., wiredly) or wirelessly. According to an embodiment of the disclosure, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the external electronic device 102). According to an embodiment of the disclosure, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment of the disclosure, the haptic module 179 may include, for example, a motor, a piezoelectric element, or an electric stimulator.

The camera module 180 may capture a still image or moving images. According to an embodiment of the disclosure, the camera module 180 may include one or more lenses, image sensors, image signal processors, or flashes.

The power management module 188 may manage power supplied to the electronic device 101. According to one embodiment of the disclosure, the power management module 188 may be implemented as at least part of, for example, a power management integrated circuit (PMIC).

The battery 189 may supply power to at least one component of the electronic device 101. According to an embodiment of the disclosure, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the external electronic device 102, the external electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment of the disclosure, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment of the disclosure, the antenna module 197 may include an antenna including a radiating element including a conductive material or a conductive pattern formed in or on a substrate (e.g., a PCB). According to an embodiment of the disclosure, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment of the disclosure, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment of the disclosure, commands or data may be transmitted or received between the electronic device 101 and the external electronic device 104 via the server 108 coupled with the second network 199. Each of the external electronic devices 102 and 104 may be a device of a same type as, or a different type, from the electronic device 101. According to an embodiment of the disclosure, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
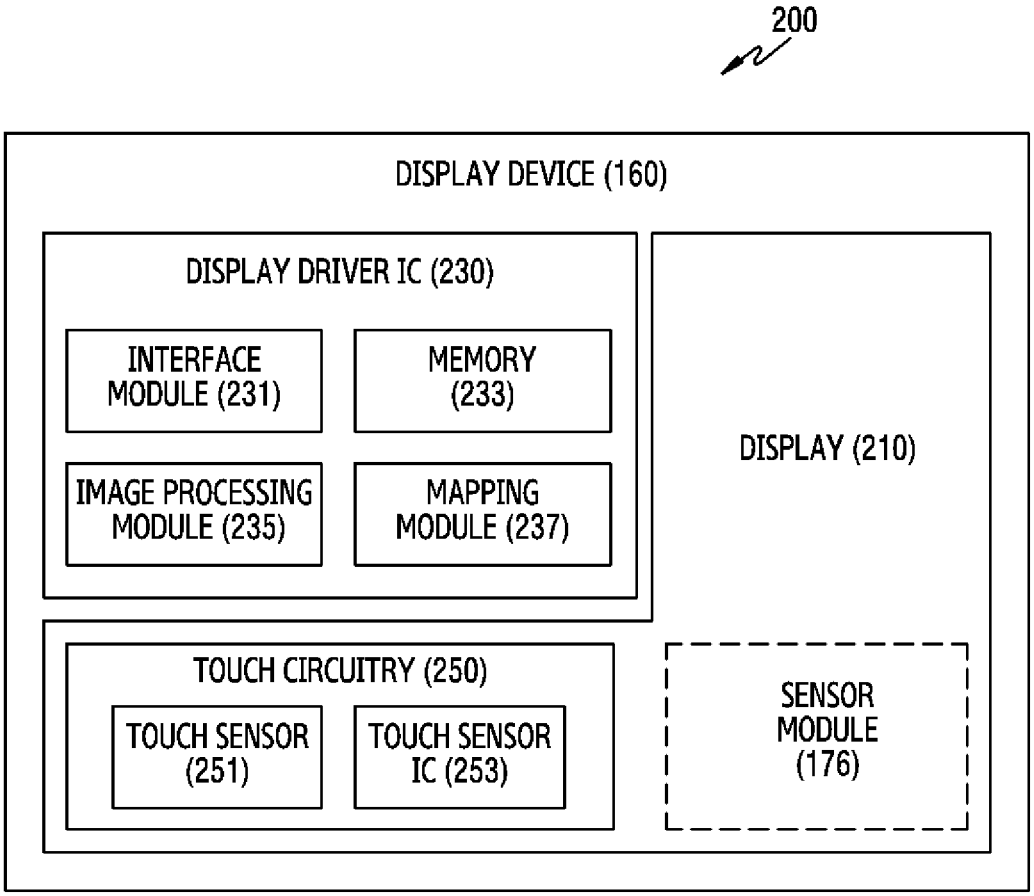
FIG. 2 is a block diagram illustrating a display device according to an embodiment of the disclosure.

FIG. 2 is a block diagram 200 illustrating a display device 160 according to an embodiment of the disclosure.

Referring to FIG. 2, the display device 160 may include a display 210 and a display driver integrated circuit (DDI) 230 to control the display 210. The DDI 230 may include an interface module 231, memory 233 (e.g., buffer memory), an image processing module 235, or a mapping module 237. The DDI 230 may receive image information that contains image data or an image control signal corresponding to a command to control the image data from another component of the electronic device 101 via the interface module 231. For example, according to an embodiment of the disclosure, the image information may be received from the processor 120 (e.g., the main processor 121 (e.g., an application processor)) or the auxiliary processor 123 (e.g., a graphics processing unit) operated independently from the function of the main processor 121. The DDI 230 may communicate, for example, with touch circuitry 250 or the sensor module 176 via the interface module 231. The DDI 230 may also store at least part of the received image information in the memory 233, for example, on a frame by frame basis. The image processing module 235 may perform pre-processing or post-processing (e.g., adjustment of resolution, brightness, or size) with respect to at least part of the image data. According to an embodiment of the disclosure, the pre-processing or post-processing may be performed, for example, based at least in part on one or more characteristics of the image data or one or more characteristics of the display 210. The mapping module 237 may generate a voltage value or a current value corresponding to the image data pre-processed or post-processed by the image processing module 235. According to an embodiment of the disclosure, the generating of the voltage value or current value may be performed, for example, based at least in part on one or more attributes of the pixels (e.g., an array, such as an RGB stripe or a pentile structure, of the pixels, or the size of each subpixel). At least some pixels of the display 210 may be driven, for example, based at least in part on the voltage value or the current value such that visual information (e.g., a text, an image, or an icon) corresponding to the image data may be displayed via the display 210.

According to an embodiment of the disclosure, the display device 160 may further include the touch circuitry 250. The touch circuitry 250 may include a touch sensor 251 and a touch sensor IC 253 to control the touch sensor 251. The touch sensor IC 253 may control the touch sensor 251 to detect a touch input or a hovering input with respect to a certain position on the display 210. To achieve this, for example, the touch sensor 251 may detect (e.g., measure) a change in a signal (e.g., a voltage, a quantity of light, a resistance, or a quantity of one or more electric charges) corresponding to the certain position on the display 210. The touch circuitry 250 may provide input information (e.g., a position, an area, a pressure, or a time) indicative of the touch input or the hovering input detected via the touch sensor 251 to the processor 120. According to an embodiment of the disclosure, at least part (e.g., the touch sensor IC 253) of the touch circuitry 250 may be formed as part of the display 210 or the DDI 230, or as part of another component (e.g., the auxiliary processor 123) disposed outside the display device 160.

According to an embodiment of the disclosure, the display device 160 may further include at least one sensor (e.g., a fingerprint sensor, an iris sensor, a pressure sensor, or an illuminance sensor) of the sensor module 176 or a control circuit for the at least one sensor. In such a case, the at least one sensor or the control circuit for the at least one sensor may be embedded in one portion of a component (e.g., the display 210, the DDI 230, or the touch circuitry 250)) of the display device 160. For example, when the sensor module 176 embedded in the display device 160 includes a biometric sensor (e.g., a fingerprint sensor), the biometric sensor may obtain biometric information (e.g., a fingerprint image) corresponding to a touch input received via a portion of the display 210. As another example, when the sensor module 176 embedded in the display device 160 includes a pressure sensor, the pressure sensor may obtain pressure information corresponding to a touch input received via a partial or whole area of the display 210. According to an embodiment of the disclosure, the touch sensor 251 or the sensor module 176 may be disposed between pixels in a pixel layer of the display 210, or over or under the pixel layer.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment of the disclosure, the module may be implemented in a form of an application-specific integrated circuit (ASIC).

Various embodiments as set forth herein may be implemented as software (e.g., the program 140) including one or more instructions that are stored in a storage medium (e.g., an internal memory 136 or an external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment of the disclosure, a method according to various embodiments of the disclosure may be included and provided in a computer program product. The computer program product may be traded as a product between a seller and a buyer. The computer program product may be distributed in the form of a machine-readable storage medium (e.g., a compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments of the disclosure, each component (e.g., a module or a program) of the above-described components may include a single entity or multiple entities. According to various embodiments of the disclosure, one or more of the above-described components may be omitted, or one or more other components may be added. Alternatively or additionally, a plurality of components (e.g., modules or programs) may be integrated into a single component. In such a case, according to various embodiments of the disclosure, the integrated component may still perform one or more functions of each of the plurality of components in the same or similar manner as they are performed by a corresponding one of the plurality of components before the integration. According to various embodiments of the disclosure, operations performed by the module, the program, or another component may be carried out sequentially, in parallel, repeatedly, or heuristically, or one or more of the operations may be executed in a different order or omitted, or one or more other operations may be added.

Figure 3:
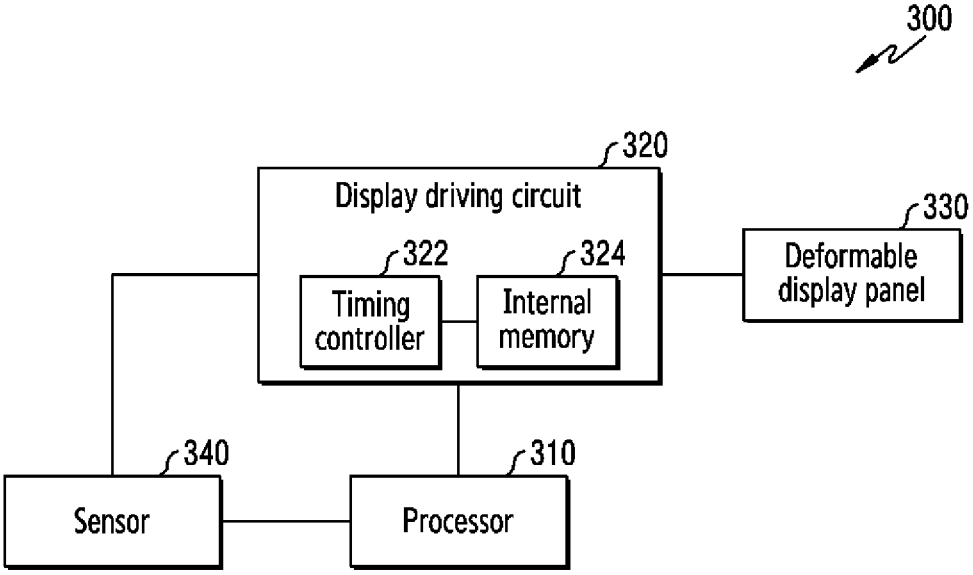
FIG. 3 is a simplified block diagram of an electronic device according to an embodiment of the disclosure.

FIG. 3 is a simplified block diagram of an electronic device according to an embodiment of the disclosure. At least the part of an electronic device 300 illustrated in FIG. 3 may be included in the electronic device 101 illustrated in FIG. 1.

Figure 4:
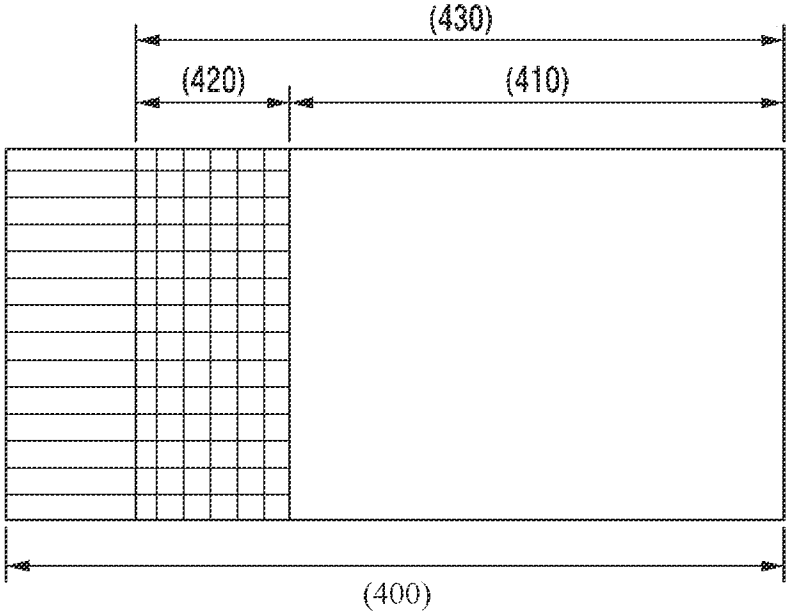
FIG. 4 illustrates generating data by a processor of an electronic device according to an embodiment of the disclosure.

FIG. 4 illustrates generating data by a processor of an electronic device according to an embodiment of the disclosure.

Figure 5:
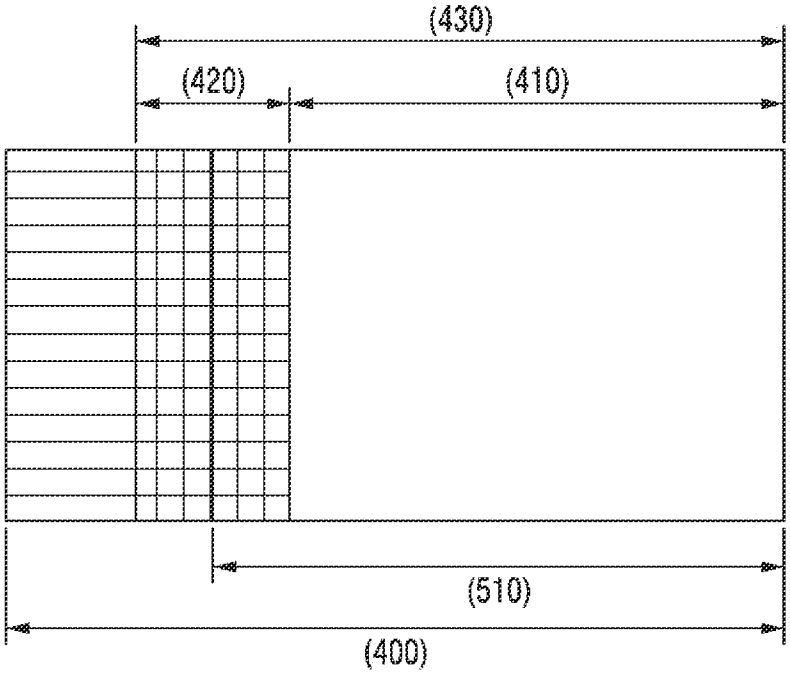
FIG. 5 illustrates scanning by a display driving circuit of an electronic device according to an embodiment of the disclosure.

FIG. 5 illustrates scanning by a display driving circuit of an electronic device according to an embodiment of the disclosure.

Figure 6:
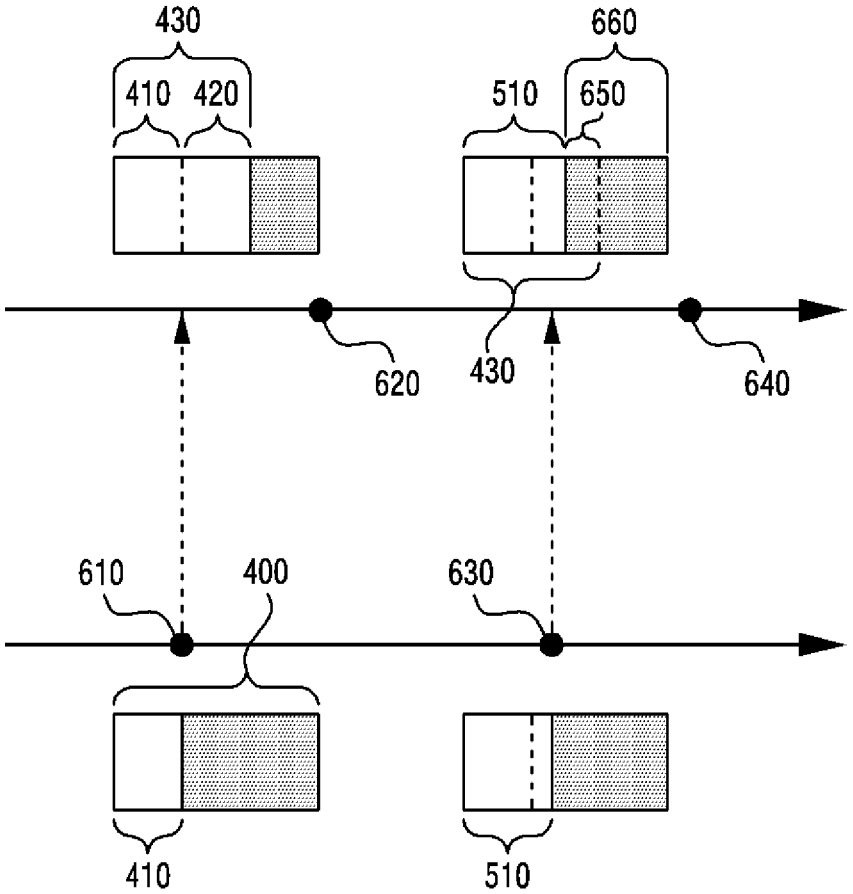
FIG. 6 is a timing diagram illustrating data generation and data scanning according to an embodiment of the disclosure.

FIG. 6 is a timing diagram illustrating data generation and data scanning according to an embodiment of the disclosure.

Figure 7:
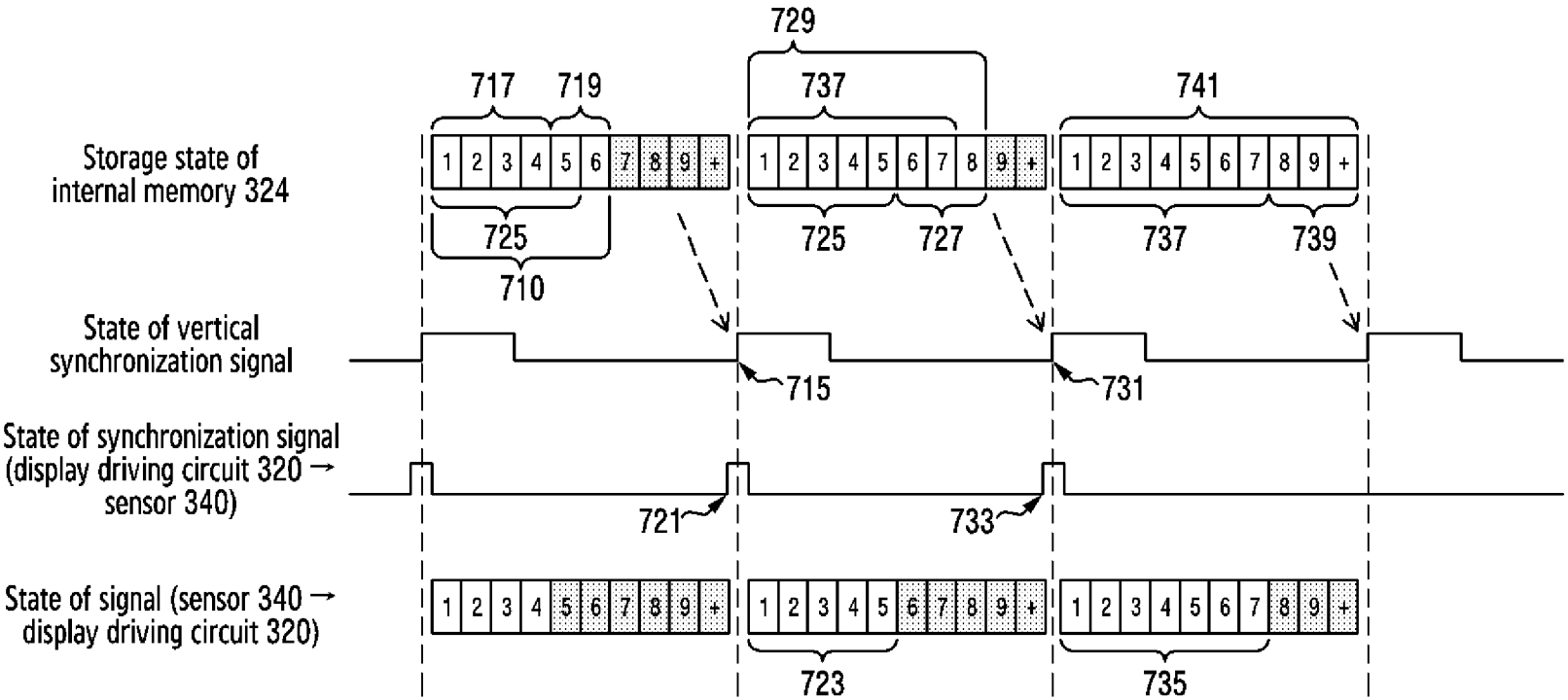
FIG. 7 is a timing diagram illustrating a synchronization signal transmitted from a display driving circuit to a sensor according to an embodiment of the disclosure.

FIG. 7 is a timing diagram illustrating a synchronization signal transmitted from a display driving circuit to a sensor according to an embodiment of the disclosure.

Figure 8:
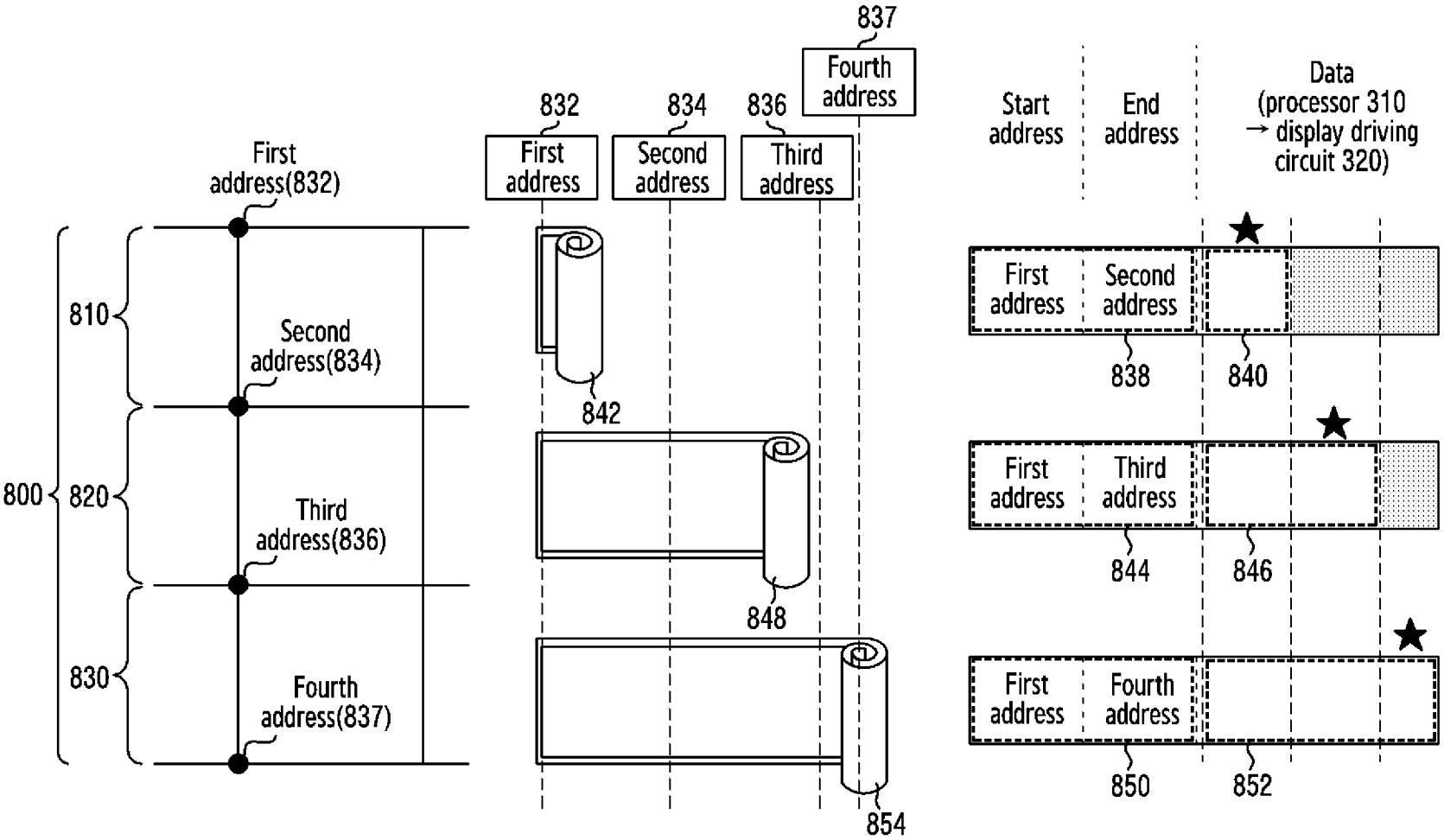
FIG. 8 illustrates, based on identification that a displayable area of a deformable display panel includes at least some of lines within one of sets divided from an entire area of the deformable display panel, acquiring data for displaying an image on the lines within the set according to an embodiment of the disclosure.

FIG. 8 illustrates, based on identification that a displayable area of a deformable display panel includes at least some of lines within one of sets divided from an entire area of the deformable display panel, acquiring data for displaying an image on the lines within the set according to an embodiment of the disclosure.

Figure 9:
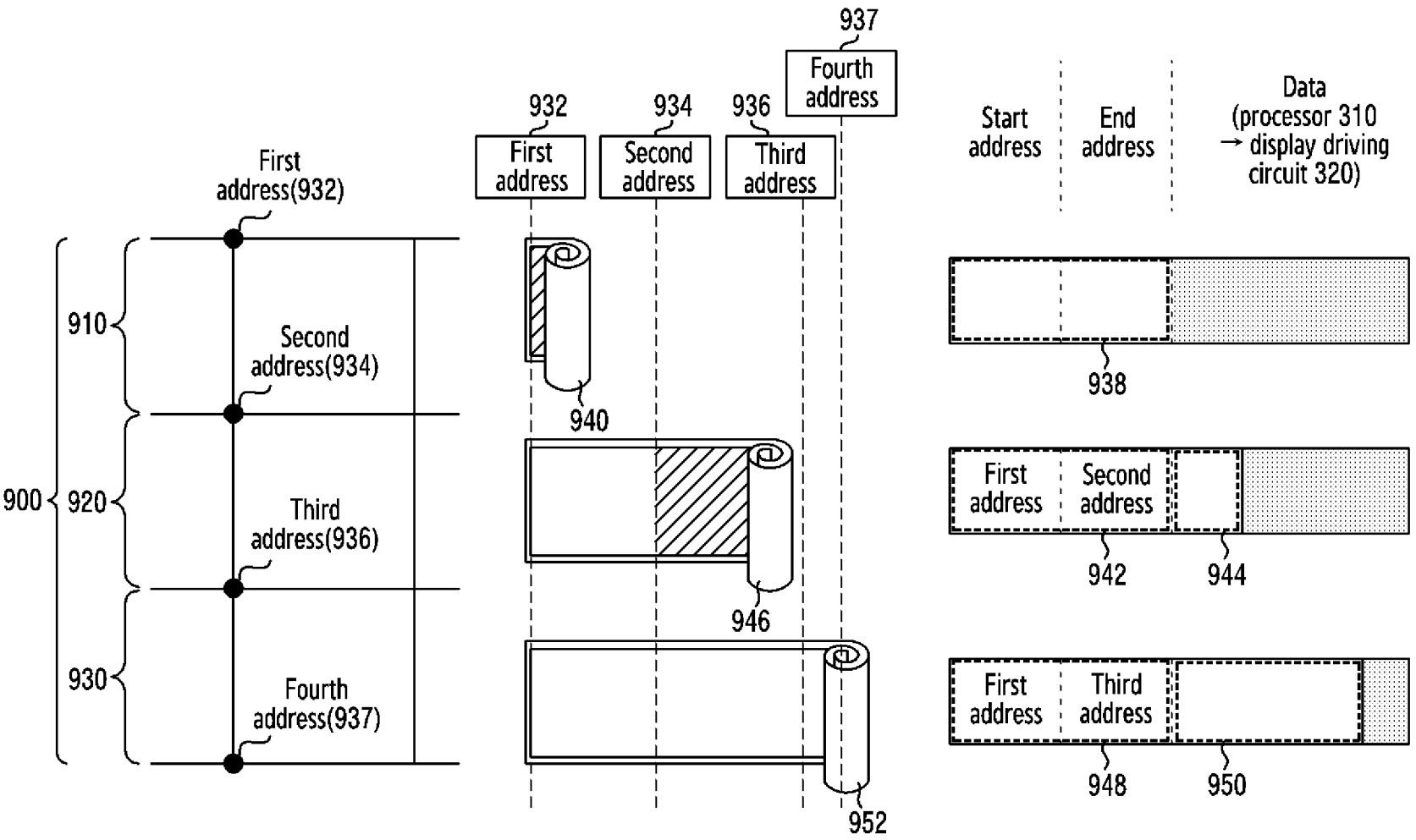
FIG. 9 illustrates, based on identification that a displayable area of a deformable display panel includes all of lines within one of sets divided from an entire area of the deformable display panel, acquiring data for displaying an image on the lines within the set according to an embodiment of the disclosure.

FIG. 9 illustrates of, based on identification that a displayable area of a deformable display panel includes all of lines within one of sets divided from an entire area of the deformable display panel, acquiring data for displaying an image on the lines within the set according to an embodiment of the disclosure.

Referring to FIG. 3, the electronic device 300 may include a processor 310, a display driving circuit (display driving integrated circuit) 320, a deformable display panel 330, and a sensor 340.

The processor 310 may include the processor 120 illustrated in FIG. 1, the display driving circuit 320 may include the display driver IC 230 illustrated in FIG. 2, the deformable display panel 330 may include the display 210 illustrated in FIG. 2, and the sensor 340 may include at least some of the sensor module 176 illustrated in FIG. 1.

In various embodiments of the disclosure, the processor 310 may be operatively coupled or connected to the display driving circuit 320. In various embodiments of the disclosure, the processor 310 may be operatively coupled or connected to the sensor 340.

In various embodiments of the disclosure, the display driving circuit 320 may be operatively coupled or connected to the deformable display panel 330. In various embodiments of the disclosure, the display driving circuit 320 may be operatively coupled or connected to the sensor 340. In various embodiments of the disclosure, the display driving circuit 320 may include a timing controller 322 and an internal memory 324.

In various embodiments of the disclosure, the deformable display panel 330 may be operatively coupled or connected to the display driving circuit 320. In various embodiments of the disclosure, the deformable display panel 330 may include a rollable display panel, an extendable display panel, a flexible display panel, or a foldable display panel.

In various embodiments of the disclosure, the sensor 340 may be operatively coupled or connected to the processor 310. In various embodiments of the disclosure, the sensor 340 may be operatively coupled or connected to the display driving circuit 320. In various embodiments of the disclosure, the sensor 340 may include at least one sensor configured to identify a position of the electronic device 300. For example, the sensor 340 may include an angle measurement sensor, an acceleration sensor, a gyro sensor, a proximity sensor, a magnetic sensor, or a combination thereof.

In various embodiments of the disclosure, the sensor 340 may generate or acquire a signal indicating or identifying the size of a displayable area of the deformable display panel 330. For example, the sensor 340 may generate or acquire a signal for identifying a displayable area within an entire area of the deformable display panel 330. For example, the displayable area may be an area exposed to the outside. For example, the displayable area may be an exposed area to provide information to a user in the entire area. For example, the displayable area may be a screen displayed through the deformable display panel 330 or an area having a state in which an image can be viewed by the user. For example, when the electronic device 300 is an electronic device having a rollable display panel, the displayable area may be at least a portion of the remaining area except for an area inserted into the housing of the electronic device 300 in the entire area. However, this is not limiting. The displayable area may be referred to as an active area in that the displayable area is an area in a state in which information can be provided to the user. The displayable area may be referred to as a viewed area in that the displayable area is an area in a state which can be viewed by the user. The displayable area may be referred to as an exposed area in that the displayable area is an area in a state exposed to the outside.

In various embodiments of the disclosure, the sensor 340 may acquire sensing data indicating a position of the electronic device 300 and generate or acquire a signal for indicating or identifying the size of the displayable area based on the acquired sensing data. In various embodiments of the disclosure, the sensor 340 may generate or acquire a signal for indicating or identifying the size of the displayable area from the acquired sensing data through an auxiliary processor (for example, a sensor hub not shown in FIG. 3) included in the sensor 340 or operatively connected to the sensor 340.

In various embodiments of the disclosure, the signal may be configured in various formats. For example, the signal may include data indicating an end address of the displayable area. For example, when the deformable display panel 330 is a display panel extendable in a single direction, the signal may include only data indicating the end address of the displayable area. In another example, the signal may include all pieces of data indicating a start address of the displayable area and data indicating the end address of the displayable area. For example, when the deformable display panel 330 is a display panel extendable in both directions, the signal may include all pieces of data indicating the start address of the displayable area and data indicating the end address of the displayable area in order to indicate the size of the displayable area. In another example, the signal may include data indicating a height of the displayable area, data indicating a width of the displayable area, or a combination thereof. For example, when the deformable display panel 330 is a display panel extendable in a signal direction, the signal may include only one piece of the data indicating the height of the displayable area and the data indicating the width of the displayable area. For example, when the deformable display panel 330 is a display panel extendable in multiple directions, the signal may include all pieces of the data indicating the height of the displayable area and the data indicating the width of the displayable area. The signal including the data indicating the height of the displayable area, the data indicating the width of the displayable area, or a combination thereof may further include data indicating the start address of the displayable area. However, this is not limiting.

In various embodiments of the disclosure, the sensor 340 may transmit the signal to the processor 310. In various embodiments of the disclosure, the sensor 340 may transmit the signal to the display driving circuit 320. For example, the signal may be directly transmitted from the sensor 340 to the processor 310 or the display driving circuit 320 without passing through another element of the electronic device 300. In another example, the signal may be transmitted from the sensor 340 to the processor 310 or the display driving circuit 320 via another element of the electronic device 300. In various embodiments of the disclosure, when the signal is generated or acquired by the auxiliary processor, the signal may be transmitted from the auxiliary processor to the processor 310 or the display driving circuit 320. However, this is not limiting.

In various embodiments of the disclosure, the signal may be transmitted to the processor 310 or the display driving circuit 320 based on a predetermined timing (designated timing or specific timing). For example, the signal may be transmitted from the sensor 340 to the processor 310 based on a synchronization signal (for example, a Tearing Effect (TE) signal provided from the display driving circuit 320 to the processor 310) for controlling, by the processor 310, a timing at which data (for example, frame data) is written in the internal memory 324 included in the display driving circuit 320. For example, the signal may be transmitted from the sensor 340 to the processor 310 at a timing at which the processor 310 acquires the synchronization signal or at a timing before a predetermined time interval from a timing at which the processor 310 acquires the synchronization signal. However, this is not limiting. In another example, the signal may be transmitted from the sensor 340 to the display driving circuit 320 based on a vertical synchronization signal for controlling a timing at which the display driving circuit 320 displays an image through the deformable display panel 330. For example, the signal may be transmitted from the sensor 340 to the display driving circuit 320 at a timing at which the display driving circuit 320 acquires the vertical synchronization signal or at a timing before a predetermined time interval from a timing at which the display driving circuit 320 acquires the vertical synchronization signal. For example, when the signal is transmitted at a timing before the predetermined time interval from a timing at which the display driving circuit 320 acquires the vertical synchronization signal, the signal may be transmitted from the sensor 340 to the display driving circuit 320 within a porch interval of the vertical synchronization signal (for example, a back porch interval of the vertical synchronization signal or a front porch interval of the vertical synchronization signal). However, this is not limiting.

In various embodiments of the disclosure, the signal may be transmitted from the sensor 340 to the processor 310 or from the sensor 340 to the display driving circuit 320 according to every predetermined period. In various embodiments of the disclosure, the signal may be transmitted from the sensor 340 to the processor 310 or from the sensor 340 to the display driving circuit 320 in response to detection of a change in the size of the displayable area of the deformable display panel 330.

In various embodiments of the disclosure, the signal transmitted to the processor 310 may be used to generate an image to be displayed through the deformable display panel 330. For example, the processor 310 may identify or determine the size of the image to be displayed through the deformable display panel 330 based on the signal and generate the image having the identified or determined size.

In various embodiments of the disclosure, the signal transmitted to the display driving circuit 320 may be used to determine or identify an area for scanning data within a storage space of the internal memory 324. For example, the display driving circuit 320 may identify a space corresponding to the displayable area of the deformable display panel 330 within the storage space and scan data within the identified space.

In various embodiments of the disclosure, the signal transmitted to the display driving circuit 320 may be configured to be the same as or different from the signal transmitted to the processor 310. For example, when the signal transmitted to the display driving circuit 320 is configured to be the same as the signal transmitted to the processor 310, the display driving circuit 320 may acquire data on a start address for performing the scanning and data on an end address for performing the scanning among a plurality of addresses configured for the storage space of the internal memory 324 based on the signal and perform the scanning based on the data on the start address and the data on the end address. In another example, when the signal transmitted to the display driving circuit 320 is configured to be different from the signal transmitted to the processor 310, the sensor 340 may generate the signal including data on a start address for performing the scanning and data on an end address for performing the scanning and transmit the generated signal to the display driving circuit 320 in order to indicate the displayable area in the entire area of the deformable display panel 330. However, this is not limiting.

In various embodiments of the disclosure, the processor 310 may receive the signal from the sensor 340. For example, the processor 310 may receive the signal while the size of the displayable area of the deformable display panel 330 is changed. The processor 310 may generate an image based on the signal in response to the reception. For example, the processor 310 may generate data for displaying an image having the size obtained by adding the size of a margin area to the size of the displayable area indicated by the signal. In various embodiments of the disclosure, the margin area may be configured to consider the size of the displayable area changed until the image is displayed after the signal is received from the sensor 340. In various embodiments of the disclosure, the processor 310 may determine or identify the size of the margin area based on a speed at which the size of the displayable area of the deformable display panel 330 is changed. For example, when the speed at which the displayable area is changed is a first speed, the determined size of the margin area may be larger than the size of the margin area determined when the speed at which the displayable area is changed is a second speed smaller than the first speed. In various embodiments of the disclosure, the processor 310 may identify the speed at which the displayable area is changed based on the signal received from the sensor 340 at a first timing and the signal received from the sensor 340 at a second timing next to the first timing and determine or identify the size of the margin area based on the identified speed.

Referring to FIG. 4, the processor 310 may receive the signal indicating that the displayable area of the deformable display panel 330 within the entire area 400 of the deformable display panel 330 is an area 410 while the size of the displayable area of the deformable display panel 330 is changed. The processor 310 may determine an area 420 as the margin area based on the speed at which the displayable area of the deformable display panel 330 is changed. The processor 310 may generate data for displaying an image within an area 430 including the area 410 and the area 420.

In various embodiments of the disclosure, the processor 310 may transmit the data to the display driving circuit 320 in order to record the data in the internal memory 324. In various embodiments of the disclosure, the processor 310 may transmit the data to the display driving circuit 320 based on a synchronization signal (for example, a Tearing Effect (TE) signal) for controlling a timing at which the processor 310 records the data in the internal memory 324. In various embodiments of the disclosure, the synchronization signal may be generated by the timing controller 322 which is included in the display driving circuit 320 or disposed outside the display driving circuit 320 and is operatively connected to the display driving circuit 320. The display driving circuit 320 may receive the data from the processor 310 and record the received data in the internal memory 324.

In various embodiments of the disclosure, the display driving circuit 320 may determine some pieces of the recorded data to be scanned based on the signal received from the sensor 340. For example, since the size of the displayable area of the deformable display panel 330 can be changed after the data is recorded in the internal memory 324, the display driving circuit 320 may determine some pieces of the recorded data to be scanned based on the signal received from the sensor 340.

Referring to FIG. 5, the display driving circuit 320 may receive the data which is transmitted from the processor 310 to display an image within the area 430 including the area 410 and the area 420 and record the received data in the internal memory 324. The display driving circuit 320 may receive the signal from the sensor 340 before performing the scanning after recording the data. The signal transmitted from the sensor 340 to the display driving circuit 320 may indicate that the size of the deformable display panel 330 is an area 510. For example, the signal transmitted from the sensor 340 to the display driving circuit 320 may indicate that the size of the deformable display panel 330 is changed from the area 410 to the area 510. The display driving circuit 320 may scan some pieces of the recorded data corresponding to the area 510 in the recorded data for displaying the image in the area 430 based on the signal received from the sensor 340. The display driving circuit 320 may display an image having the size of the area 510 through the deformable display panel 330 based on the scanning.

Referring to FIG. 6, the sensor 340 may transmit the signal indicating that the displayable area of the deformable display panel 330 is the area 410 to the processor 310 at a timing 610. The processor 310 may receive the signal indicating that the displayable area of the deformable display panel 330 is the area 410 from the sensor 340 at the timing 610. The processor 310 may generate data for displaying the image having the size of the area 430 obtained by adding the area 420 corresponding to the margin area to the area 410 in response to the reception and transmit the generated data to the display driving circuit 320. The display driving circuit 320 may receive the data from the processor 310 and record or store the received data in the internal memory 324. For example, the data may be recorded in the internal memory 324 at a timing 620. The display driving circuit 320 may receive the signal indicating that the displayable area of the deformable display panel 330 is the area 510 from the sensor 340 at a timing 630 while the data is recorded in the internal memory 324. The display driving circuit 320 may display the image having the size of the area 510 through the deformable display panel 330 by scanning some pieces of the data recorded in the internal memory 324 at a timing 640 after receiving the signal. For example, the display driving circuit 320 may display the image having the size of the area 510 through the deformable display panel 330 by scanning some pieces of the recorded data corresponding to the area 510 at the timing 640 determined based on the vertical synchronization signal acquired from the timing controller 322 after receiving the signal. For example, the display driving circuit 320 may scan some pieces of the recorded data corresponding to the area 510 at the timing 640 and forgo or bypass the scanning of some pieces of the remaining recorded data corresponding to the area 650. The electronic device 300 according to various embodiments may display the image with low latency or without any latency in response to a change in the displayable area of the deformable display 340 based on the signal from the sensor 340 to the processor 310 and the signal from the sensor 340 to the display driving circuit 320.

In various embodiments of the disclosure, the display driving circuit 320 may deactivate the remaining areas except for the displayable area among the entire area of the deformable display panel 330 while the image is displayed within the displayable area of the deformable display panel 330 based on the scanning of some pieces of the data recorded in the internal memory 324. For example, the display driving circuit 320 may deactivate the remaining areas by blocking the supply of power to light-emitting diodes disposed in the remaining areas. In another example, the display driving circuit 320 may limit light emission from the light-emitting diodes disposed in the remaining areas. For example, referring to FIG. 6, the display driving circuit 320 may deactivate an area 660 corresponding to the remaining areas while the image is displayed in the displayable area 510. However, this is not limiting.

In various embodiments of the disclosure, the display driving circuit 320 may display a black image in the remaining areas except for the displayable area among the entire area of the deformable display panel 330 while the image is displayed in the displayable area of the deformable display panel 330 based on the scanning of some pieces of the data recorded in the internal memory 324. For example, the display driving circuit 320 may combine the image to be displayed in the displayable area, which is acquired based on the scanning of some pieces of the data, and the black image to be displayed in the remaining areas and display the image in the displayable area and the black image in the remaining areas in response to the combination. For example, referring to FIG. 6, the display driving circuit 320 may display the black image in the area 660 corresponding to the remaining areas while the image is displayed in the displayable area 510. However, this is not limiting.

In various embodiments of the disclosure, the display driving circuit 320 may transmit or provide a synchronization signal to the sensor 340 using the timing controller 322 in order to control a timing at which the signal is received from the sensor 340. In various embodiments of the disclosure, the synchronization signal may be used to control a timing at which the sensor 340 transmits the signal indicating the displayable area of the deformable display panel 220 to the display driving circuit 320. In various embodiments of the disclosure, the synchronization signal may be generated by the timing controller 322. In various embodiments of the disclosure, the timing at which the synchronization signal is generated or the synchronization signal is provided from the display driving circuit 320 (or the timing controller 322) to the sensor 340 may be relevant to the vertical synchronization signal. For example, the timing at which the synchronization signal is generated or the synchronization signal is provided from the display driving circuit 320 (or the timing controller 322) to the sensor 340 may be a timing at which the vertical synchronization signal is acquired or a timing before a predetermined time interval from a timing at which the vertical synchronization signal is acquired. For example, the timing before the predetermined time interval from the timing at which the vertical synchronization signal is acquired may be within a porch interval of the vertical synchronization signal. The sensor 340 may transmit the signal indicating the displayable area of the deformable display panel 330 based on the timing at which the synchronization signal is acquired.

Referring to FIG. 7, the display driving circuit 320 may acquire the vertical synchronization signal at a timing 715 in order to scan data 710 for displaying an image having a first size recorded in the internal memory 324. The data 710 may include data 717 corresponding to a displayable area identified when the image having the first size is generated and data 719 corresponding to a margin area identified when the image having the first size is generated. Meanwhile, the display driving circuit 320 may transmit the synchronization signal to the sensor 340 at a timing 721. For example, the timing 721 may be within a porch interval of the vertical synchronization signal acquired at the timing 715 or a porch interval of the vertical synchronization signal acquired directly before the vertical synchronization signal acquired at the timing 715. The sensor 340 may transmit a signal indicating that the size of the displayable area is a size 723 to the display driving circuit 320 based on the synchronization signal transmitted to the sensor 340 at the timing 721 before the display driving circuit 320 performs the scanning based on the vertical synchronization signal acquired at the timing 715. The display driving circuit 320 may display the image having the size 723 through the deformable display panel 330 by scanning data 725 which is a portion of the data 710 indicated by the signal based on the vertical synchronization signal acquired at the timing 715.

Meanwhile, the processor 310 may transmit data 729 for displaying an image having a second size larger than the first size to the display driving circuit 320, the data 729 including the data 725 corresponding to the size 723 of the displayable area and the data 727 corresponding to the size of the margin area in the internal memory 324, based on a signal, indicating that the size of the displayable area is the size 723, which is transmitted from the sensor 340 to the processor 310 at a timing indicated by a synchronization signal (for example, a TE signal, not shown in FIG. 7) provided from the display driving circuit 320 (or timing controller 322) to the processor 310. The display driving circuit 320 may record the received data 729 in the internal memory 324.

The display driving circuit 320 may acquire a vertical synchronization signal at a timing 731 in order to scan the data 729 for displaying the image having the second size, recorded in the internal memory 324. Meanwhile, the display driving circuit 320 may transmit the synchronization signal to the sensor 340 at a timing 733. For example, the timing 733 may be within the porch interval of the synchronization signal acquired at the timing 731 or a porch interval of the vertical synchronization signal acquired directly before the vertical synchronization signal acquired at the timing 731. The sensor 340 may transmit a signal indicating that the size of the displayable area is the size 735 to the display driving circuit 320 based on the synchronization signal transmitted to the sensor 340 at the timing 733 before the display 320 performs the scanning based on the vertical synchronization signal acquired at the timing 731. The display driving circuit 320 may display the image having the size 735 through the deformable display panel 330 by scanning data 737 which is a portion of the data 729 indicated by the signal based on the vertical synchronization signal acquired at the timing 731.

Meanwhile, the processor 310 may transmit data 741 for displaying an image having a third size larger than the second size to the display driving circuit 320, the data 741 including the data 737 corresponding to the size 735 of the displayable area and the data 739 corresponding to the size of the margin area in the internal memory 324, based on a signal, indicating that the size of the displayable area is the size 735, which is transmitted from the sensor 340 to the processor 310 at a timing indicated by a synchronization signal (for example, a TE signal, not shown in FIG. 7) provided from the display driving circuit 320 (or timing controller 322) to the processor 310. The display driving circuit 320 may record the received data 741 in the internal memory 324.

As described above, the electronic device 300 according to various embodiments may enhance efficiency of the operations for displaying the image according to a change in the size of the displayable area through a synchronization signal provided form the display driving circuit 320 to the sensor 340.

In various embodiments of the disclosure, the electronic device 300 may divide a plurality of lines included in the entire area of the deformable display panel 330 into sets and manage the displayable area of the deformable display panel 330 in units corresponding to each of the divided sets. For example, when the entire area includes 100 lines, the electronic device 300 may classify first to twentieth lines among the 100 lines as a first set, twenty-first to fortieth lines among the 100 lines as a second set, forty-first to sixtieth lines as a third set, sixty-first to eightieth lines among 100 lines as a fourth set, and eighty-first to one hundredth lines among 100 lines as a fifth set. The electronic device 300 may manage the displayable area of the deformable display panel 330 in units corresponding to each of the first set, the second set, the third set, the fourth set, and the fifth set.

In various embodiments of the disclosure, the electronic device 300 may determine the size of an image to be displayed, based on identification that the displayable area of the deformable display panel 330 includes some of the lines within each of the sets. For example, the sensor 340 may transmit the signal for identifying the displayable area within the entire area of the deformable display panel 330 to the processor 310. The processor 310 may identify whether the displayable area identified based on the signal includes some of the lines of the first set among the sets. The processor 310 may forgo or bypass the generation of data for displaying the image through all lines of the first set based on identification that the displayable area does not include all the lines of the first set. The processor 310 may generate data for displaying the image through all the lines of the first set based on identification that the displayable area includes some of the lines of the first set and transmit the generated data to the display driving circuit 320. The display driving circuit 320 may record the received data in the internal memory 324. The display driving circuit 320 may display the image through all the lines of the first set by scanning the recorded data. In another example, the sensor 340 may transmit the signal indicating that the displayable area includes all the lines of the first set to the processor 310 based on identification that some of the lines of the first set among the sets are included in the displayable area. The processor 310 may receive the signal from the sensor 340. The processor 310 may generate data for displaying the image through all the lines of the first set in response to the reception and transmit the data to the display driving circuit 320. The display driving circuit 320 may receive the data from the processor 310 and record the received data in the internal memory 324. The display driving circuit 320 may display the image through all the lines of the first set by scanning the recorded data.

Referring to FIG. 8, a plurality of lines included in an entire area 800 of the deformable display panel 330 may be divided into sets 810, 820, and 830.

The sensor 340 may transmit a signal 838 including a first address 832 as a start address and a second address 834 as an end address to the processor 310 based on identification that the displayable area of the deformable display panel 330 includes some of the lines included in the set 810. The processor 310 may receive the signal 838 from the sensor 340. The processor 310 may generate data 840 for displaying the image on all the lines in the set 810 in response to the reception and transmit the generated data 840 to the display driving circuit 320. The display driving circuit 320 may record the data 840 in the internal memory 324. The display driving circuit 320 may display the image on all the lines in the set 810 by scanning the data 840 recorded in the internal memory 324. For example, the display driving circuit 320 may display the image on all the lines in the set 810 even though all the lines in the set 810 are not included in the displayable area as shown in a state 842.

The sensor 340 may transmit a signal 844 including the first address 832 as a start address and a third address 836 as an end address to the processor 310 based on identification that the displayable area of the deformable display panel 330 includes some of the lines included in the set 820. The processor 310 may receive the signal 844 from the sensor 340. The processor 310 may generate data 846 for displaying the image on all of the lines in the set 810 and the lines in the set 820 in response to the reception and transmit the generated data 846 to the display driving circuit 320. The display driving circuit 320 may record the data 846 in the internal memory 324. The display driving circuit 320 may display the image on all the lines in the set 810 and all the lines in the set 820 by scanning the data 846 recorded in the internal memory 324. For example, the display driving circuit 320 may display the image on all the lines in the set 820 even though all the lines in the set 820 are not included in the displayable area as indicated by a state 848.

The sensor 340 may transmit a signal 850 including the first address 832 as a start address and a fourth address 837 as an end address to the processor 310 based on identification that the displayable area of the deformable display panel 330 includes some of the lines included in the set 830. The processor 310 may receive the signal 850 from the sensor 340. The processor 310 may generate data 852 for displaying the image on all of the lines in the set 810, the lines in the set 820, and the lines in the set 830 in response to the reception and transmit the generated data 852 to the display driving circuit 320. The display driving circuit 320 may record the data 852 in the internal memory 324. The display driving circuit 320 may display the image on all the lines in the set 810, all the lines in the set 820, and all the lines in the set 830 by scanning the data 852 recorded in the internal memory 324. For example, the display driving circuit 320 may display the image on all the lines in the set 830 even though all the lines in the set 830 are not included in the displayable area as indicated by a state 854.

FIG. 8 does not illustrate an example of generating data for displaying the image based on the margin area, but is only for convenience of description. For example, the processor 310 may generate the image for each set based on the margin area. For example, the processor 310 may add the margin area determined based on a speed at which the displayable area of the deformable display panel 330 is changed to the displayable area indicated by the signal in response to reception of the signal indicating the displayable area from the sensor 340 and identify whether the area obtained by adding the margin area to the displayable area includes some of the lines in one (a) set. The processor 310 may generate data for displaying the image on all the lines of the set based on identification that the area obtained by adding the margin area to the displayable area includes some of the lines of the set. However, this is not limiting.

In various embodiments of the disclosure, the electronic device 300 may determine the size of the image to be displayed, based on identification that the displayable area of the deformable display panel 330 includes all the lines within each of the sets. For example, the sensor 340 may transmit the signal for identifying the displayable area within the entire area of the deformable display panel 330 to the processor 310. The processor 310 may identify whether the displayable area identified based on the signal includes all the lines in the first set among the sets. The processor 310 may forgo or bypass the generation or acquisition of data for displaying the image on all the lines of the first set based on identification that the displayable area includes some of the lines of the first set. The processor 310 may generate or acquire the data for displaying the image on the lines of the first set based on identification that the displayable area includes all the lines of the first set and transmit the generated data to the display driving circuit 320. The display driving circuit 320 may record the received data in the internal memory 324. The display driving circuit 320 may display the image on the lines of the first set by scanning the recorded data. In another example, the sensor 340 may forgo or bypass transmission of the signal indicating the displayable area based on identification that some of the lines of the first set among the sets are included in the displayable area. The sensor 340 may transmit the signal indicating that all the lines of the first set are included in the displayable area to the processor 310 based on identification that all the lines of the first set among the sets are included in the displayable area. The processor 310 may receive the signal from the sensor 340. The processor 310 may generate data for displaying the image on the lines of the first set in response to the reception and transmit the generated data to the display driving circuit 320. The display driving circuit 320 may receive the data from the processor 310 and record the received data in the internal memory 324. The display driving circuit 320 may display the image on the lines of the first set by scanning the recorded data.

Referring to FIG. 9, a plurality of lines included in an entire area 900 of the deformable display panel 330 may be divided into sets 910, 920, and 930.

The sensor 340 may transmit a signal 938 masking a start address and an end address to the processor 310 based on identification that the displayable area of the deformable display panel 330 includes some of the lines included in the set 910. The processor 310 may receive the signal 938 from the sensor 340. The processor 310 may identify masking of the start address and the end address and forgo or bypass the generation of data for displaying the image on the lines in the set 810 based on the identification. The deformable display panel 330 may be in a deactivated state, such as a state 940 based on the forgoing or bypassing of the generation of the data.

The sensor 340 may transmit a signal 942 including a first address 932 as a start address and a second address 934 as an end address based on identification that the displayable area of the deformable display panel 330 includes all the lines included in the set 910 and some of the lines in the set 920. The processor 310 may receive the signal 942 from the sensor 340. The processor 310 may generate data 944 for displaying the image on all the lines in the set 910 in response to the reception and transmit the generated data 944 to the display driving circuit 320. The processor 310 may bypass or forgo the generation of data for displaying the image on at least some of the lines in the set 920 in response to the reception. The display driving circuit 320 may record the data 944 in the internal memory 324. The display driving circuit 320 may display the image only on the lines in the set 910 by scanning the data 944 recorded in the internal memory 324. For example, the display driving circuit 320 may display the image on the lines in the set 910 but not display the image on at least some of the lines in the set 920 as shown in a state 946.

The sensor 340 may transmit a signal 948 including the first address 932 as a start address and a third address 936 (or a fourth address 937) as an end address based on identification that the displayable area of the deformable display panel 330 includes all the lines included in the set 910, all the lines included in the set 920, and some of the lines included in the set 930. The processor 310 may receive the signal 948 from the sensor 340. The processor 310 may generate data 950 for displaying the image on all the lines in the set 910 and all the lines in the set 920 in response to the reception and transmit the generated data 950 to the display driving circuit 320. The processor 310 may bypass or forgo the generation of data for displaying the image on at least some of the lines in the set 930 in response to the reception. The display driving circuit 320 may record the data 950 in the internal memory 324. The display driving circuit 320 may display the image only on the lines in the set 910 and the lines in the set 920 by scanning the data 950 recorded in the internal memory 324. For example, the display driving circuit 320 may display the image on the lines in the set 910 and the lines in the set 920 but not display the image on at least some of the lines in the set 930. However, this is not limiting. For example, the display driving circuit 320 may display the image on all the lines in the set 930 even though all the lines in the set 930 are not included in the displayable area as indicated by a state 952.

As described above, the electronic device 300 according to various embodiments may efficiently control displaying of the image according to a change in the displayable area of the deformable display panel 330 by dividing the entire area of the deformable display panel 330 into sets and managing the displayable area of the deformable display panel 330 based on the divided sets.

An electronic device (for example, the electronic device 300) according to various embodiments may include a deformable display panel (for example, the deformable display panel 330), a sensor (for example, the sensor 340), a display driving circuit (for example, the display driving circuit 320) operatively connected to the deformable display panel and the sensor and including a Graphical Random Access Memory (GRAM) (for example, the internal memory 324), and a processor (for example, the processor 310) operatively connected to the display driving circuit and the sensor, and the display driving circuit may be configured to store data for displaying an image having a first size received from the processor in the GRAM while a size of a displayable area of the deformable display panel is changed, receive a signal indicating that the size of the displayable area is a second size smaller than the first size after storing the data, and display the image having the second size through the deformable display panel by scanning some pieces of the data in response to reception of the signal.

In various embodiments of the disclosure, the display driving circuit may be configured to display the image having the second size through the deformable display panel by scanning some pieces of the data and forgoing scanning of some pieces of the remaining data in response to reception of the signal.

In various embodiments of the disclosure, the processor may be configured to, while the size of the displayable area is changed, receive another signal indicating that the size of the displayable area is a third size smaller than the first size from the sensor, generate the data for displaying the image having the first size obtained by adding a fourth size for a margin area to the third size in response to reception of the another signal, and transmit the data for displaying the image having the first size to the display driving circuit. For example, the processor may be configured to, while the size of the displayable area is changed, receive the another signal from the sensor using a framework installed in the electronic device, provide information on the another signal to an application executed in the electronic device using the framework, and generate the data for displaying the image having the first size obtained by adding the fourth size for the margin area to the third size, using the application based on the information on the another signal. For example, the processor may be configured to, while the size of the displayable area of the deformable display panel is changed, determine the fourth size based on a speed at which the size of the displayable area is changed, in response to reception of the another signal; and generate the data for displaying the image having the first size obtained by adding the fourth size to the third size. For example, the margin area may be at least a portion of the remaining areas except for the displayable area having the third size within the entire area of the deformable display panel.

In various embodiments of the disclosure, the display driving circuit may be configured to deactivate the remaining areas of the entire area of the deformable display panel except for an area in which the image having the second size is displayed while the image having the second size is displayed through the deformable display panel.

In various embodiments of the disclosure, the display driving circuit may be configured to display a black image in the remaining area of the entire area of the deformable display panel except for an area in which the image having the second size is displayed while the image having the second size is displayed through the deformable display panel.

In various embodiments of the disclosure, the signal may include data indicating a start address of the displayable area having the second size and data indicating an end address of the displayable area having the second size.

In various embodiments of the disclosure, the signal may include data indicating a height of the displayable area having the second size and data indicating a width of the displayable area having the second size. In various embodiments of the disclosure, the signal may further include data indicating a start address of the displayable area having the second size.

In various embodiments of the disclosure, the signal may include data indicating a start address of scanning of some pieces of the data and data indicating an end address of scanning of some pieces of the data among a plurality of addresses configured in the GRAM.

In various embodiments of the disclosure, the data may be provided from the display driving circuit to the processor and is transmitted from the processor to the display driving circuit based on a Tearing Effect (TE) signal for controlling a timing at which the data is stored in the GRAM, and the display driving circuit may be configured to receive the signal from the sensor at a timing at which a vertical synchronization signal for controlling a timing at which the image is displayed through the deformable display panel is acquired or within a porch internal of the vertical synchronization signal.

In various embodiments of the disclosure, the deformable display panel may include a rollable display panel, an extendable display panel, a flexible display panel, or a foldable display panel, and the sensor includes an angle measurement sensor, an accelerator sensor, a gyro sensor, a proximity sensor, a magnetic sensor, or a combination thereof.

The electronic device according to various embodiments as described above may include a deformable display panel (for example, the deformable display panel 330), a sensor (for example, the sensor 340), a display driving circuit (for example, the display driving circuit 320) operatively connected to the deformable display panel and the sensor and including a Graphical Random Access Memory (GRAM) (for example, the internal memory 324), and a processor (for example, the processor 310) operatively connected to the display driving circuit and the sensor, and the display driving circuit may be configured to receive a signal for identifying a displayable area within an entire area of the deformable display panel from the sensor, acquire data for displaying, in response to identification that the displayable area includes all lines of a first set among a plurality of sets included in the entire area, an image on lines of the first set and transmit the data to the display driving circuit in order to record the data in the GRAM, and forgo acquiring of the data in response to identification that the displayable area includes some of the lines of the first set.

In various embodiments of the disclosure, the display driving circuit may be configured to display the image on the lines of the first set by recording the data received from the processor in the GRAM and scanning the recorded data.

In various embodiments of the disclosure, the signal may further include data indicating a start address and an end address of the displayable area, and the processor may be configured to identify whether the displayable area includes all the lines of the first set or some of the lines of the first set among the plurality of lines based on the start address and the end address.

In various embodiments of the disclosure, the processor may be configured to forgo acquisition of the data in response to identification that the displayable area includes some of lines of a first set based on the signal, acquire other data for displaying an image on the remaining lines of the lines included in the displayable area except for the lines of the first set, and transmit the other data to the display driving circuit in order to record the other data in the GRAM.

In various embodiments of the disclosure, the sensor may be configured to transmit the signal to the processor in response to detection of a change in the size of the displayable area of the deformable display panel.

In various embodiments of the disclosure, the sensor may be configured to transmit the signal based on a predetermined period.

Figure 10:
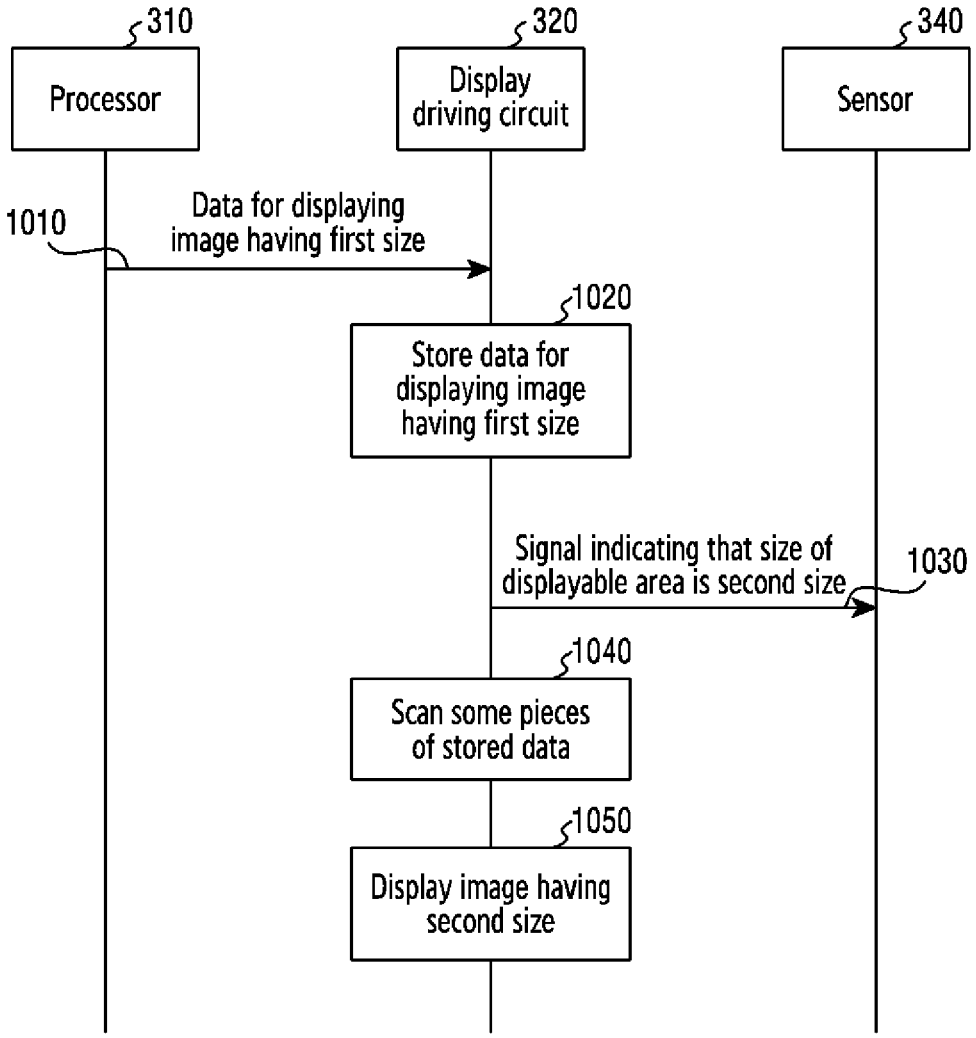
FIG. 10 is a flowchart illustrating a method of displaying an image based on a change in a size of a displayable area of a deformable display panel according to an embodiment of the disclosure.

FIG. 10 is a flowchart illustrating a method of displaying an image based on a change in a size of a displayable area of a deformable display panel according to an embodiment of the disclosure. The method may be performed by the electronic device 101 illustrated in FIG. 1, the electronic device 300 illustrated in FIG. 3, elements included in the electronic device 101, or elements included in the electronic device 300.

Referring to FIG. 10, in operation 1010, the processor 310 may transmit data for displaying an image having a first size to the display driving circuit 320 while the size of the displayable area of the deformable display panel 330 is changed. For example, the processor 310 may transmit the data for displaying the image having the first size to the display driving circuit 320 at a timing identified based on a synchronization signal (for example, TE signal) provided from the timing controller 322 to the processor 310. The display driving circuit 320 may receive the data for displaying the image having the first size from the processor 310.

In operation 1020, the display driving circuit 320 may store the data for displaying the image having the first size in the internal memory 324 (for example, a Graphical Random Access Memory (GRAM)) while the size of the displayable area of the deformable display panel 330 is changed.

In operation 1030, the display driving circuit 320 may receive a signal indicating that the size of the displayable area is a second size from the sensor 340. In various embodiments of the disclosure, the image having the first size may be an image having a size of an area obtained by adding the margin area to the displayable area of the deformable display panel 330, and thus the second size may be smaller than the first size. In various embodiments of the disclosure, the signal may include data indicating a start address of the displayable area having the second size and data indicating an end address of the displayable area having the second size. In various embodiments of the disclosure, the signal may include data indicating a height of the displayable area having the second size and data indicating a width of the displayable area having the second size. In various embodiments of the disclosure, when the signal includes the data indicating the height of the displayable area having the second size or the data indicating the width of the displayable area having the second size, the signal may further include data indicating the start address of the displayable area having the second size. In various embodiments of the disclosure, the signal may include data indicating at least one address to be scanned among a plurality of addresses configured in the internal memory 324. However, this is not limiting.

In various embodiments of the disclosure, the display driving circuit 320 may receive the signal from the sensor 340 at a timing at which a vertical synchronization signal for controlling a timing at which the image is displayed through the deformable display panel is acquired or within a porch interval of the vertical synchronization signal.

In operation 1040, the display driving circuit 320 may scan some pieces of the data stored in the internal memory 324 at a timing identified based on the vertical synchronization signal. For example, the display driving circuit 320 may scan only some pieces of the data and forgo or bypass scanning of some pieces of the remaining data in order to display the image having the second size smaller than the first size through the deformable display panel 330.

In operation 1050, the display driving circuit 320 may display the image having the second size through the deformable display panel 330 based on the scanning. In various embodiments of the disclosure, the display driving circuit 320 may be configured to deactivate the remaining areas of the deformable display panel 330 except for an area in which the image having the second size is displayed while the image having the second size is displayed through the deformable display panel 330. For example, the display driving circuit 320 may maintain the deactivated state of the remaining areas or switch the state of the remaining areas from an activated state to the deactivated state while the image having the second size is displayed through the deformable display panel 330.

As described above, the electronic device 300 according to various embodiments may identify the displayable area of the deformable display panel 330 using the signal acquired from the sensor 340 and control a scanning area of the internal memory 324 based on the identification, thereby enhancing resource efficiency. For example, the electronic device 300 according to various embodiments may save resources used for scanning and displaying some pieces of the remaining data by scanning only some pieces of the data stored in the internal memory 324 based on identification of the displayable area of the deformable display panel 330.

Figure 11:
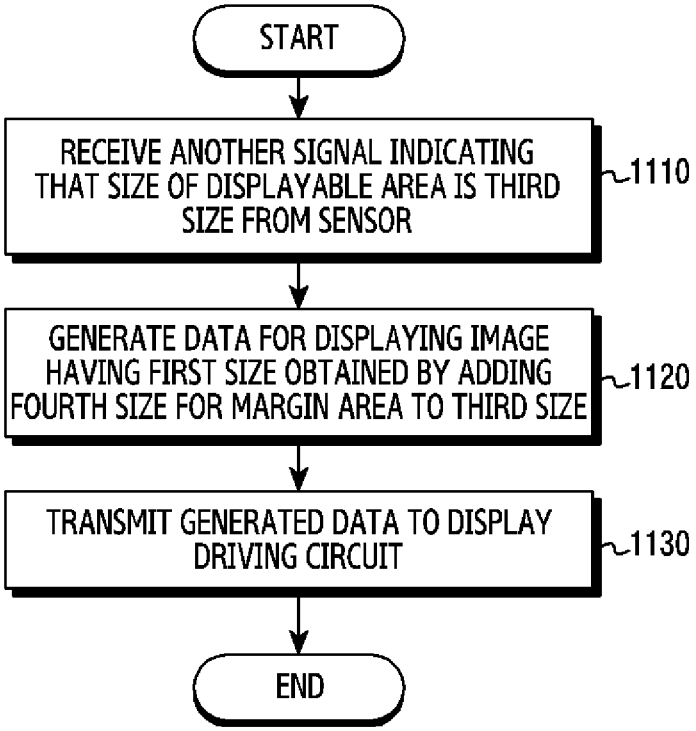
FIG. 11 is a flowchart illustrating a method of generating data for displaying an image based on a change in a size of a displayable area of a deformable display panel according to an embodiment of the disclosure.

FIG. 11 is a flowchart illustrating a method of generating data for displaying an image a change in a size of a displayable area of a deformable display panel according to an embodiment of the disclosure. The method may be performed by the electronic device 101 illustrated in FIG. 1, the electronic device 300 illustrated in FIG. 3, the processor 120 included in the electronic device 101, or the processor 310 included in the electronic device 300.

Operations 1110 to 1130 of FIG. 11 may be relevant to operation 1010 of FIG. 10.

Referring to FIG. 11, in operation 1110, the processor 310 may receive another signal indicating that the size of the displayable area is a third size from the sensor 340 while the size of the displayable area of the deformable display panel 330 is changed. For example, the other signal may be distinguished from the signal transmitted in operation 1030 of FIG. 10. For example, the other signal may be transmitted from the sensor 340 to the processor 310 before the signal is transmitted in operation 1030. In various embodiments of the disclosure, the processor 310 may receive the other signal from the sensor 340 using a framework installed in the electronic device 300 from while the size of the displayable area is changed. In various embodiments of the disclosure, the processor 310 may provide information on the other signal to an application executed within the electronic device 300 using the framework.

In operation 1120, the processor 310 may generate data for displaying the image having a first size obtained by adding a fourth size for the margin area to the third size while the size of the displayable area 330 is changed. The data for displaying the image having the first size may correspond to data for displaying the image having the first size transmitted in operation 1010. For example, the processor 310 may receive the other signal from the sensor 340 and add the fourth size for the margin area to the third size based on an elapsed time due to the generation of the data for displaying the image having the first size based on the other received signal. In various embodiments of the disclosure, the processor 310 may generate the data for displaying the image having the first size obtained by adding the fourth size for the margin area to the third size through the application based on information on the other signal.

In operation 1130, the processor 310 may transmit the data for displaying the image having the first size to the display driving circuit 320 while the size of the displayable area is changed. The display driving circuit 320 may receive the data from the processor 310.

As described above, the electronic device 300 according to various embodiments may generate data for displaying the image based on the margin area as well as the displayable area identified using the sensor 340 in order to prevent the image from being delayed while the displayable area is changed.

Figure 12:
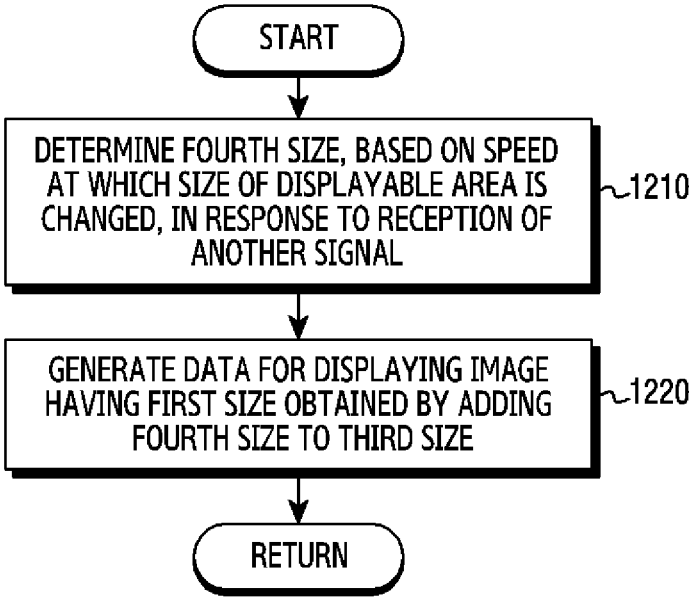
FIG. 12 is a flowchart illustrating a method of determining a margin area based on a change in a size of a displayable area of a deformable display panel according to an embodiment of the disclosure.

FIG. 12 is a flowchart illustrating a method of determining a margin area based on a change in a size of a displayable area of a deformable display panel according to an embodiment of the disclosure. The method may be performed by the electronic device 101 illustrated in FIG. 1, the electronic device 300 illustrated in FIG. 3, the processor 120 included in the electronic device 101, or the processor 310 included in the electronic device 300.

Operations 1210 to 1220 of FIG. 12 may be relevant to operation 1120 of FIG. 11.

Referring to FIG. 12, in operation 1210, the processor 310 may determine the fourth size based on a speed at which the size of the displayable area is changed in response to reception of the other signal indicating that the size of the displayable area is the third size from the sensor 340. For example, the processor 310 may identify the speed at which the displayable area is changed using the other signal indicating that the size of the displayable area is the third size and at least one signal indicating the size of the displayable area received from the sensor 340 before the other signal. The processor 310 may determine the fourth size for the margin area based on the identified speed. For example, the fourth size may be determined as a larger value to increase the identified speed and determined as a smaller value to decrease the identified speed. However, this is not limiting.

In operation 1220, the processor 310 may generate data for displaying the image having the first size obtained by adding the fourth size to the third size. For example, operation 1220 may correspond to operation 1120.

As described above, the electronic device 300 according to various embodiments may determine the size of the margin area based on the speed at which the displayable area is changed, thereby preventing displaying of the image from being delayed while the displayable area is changed.

Figure 13:
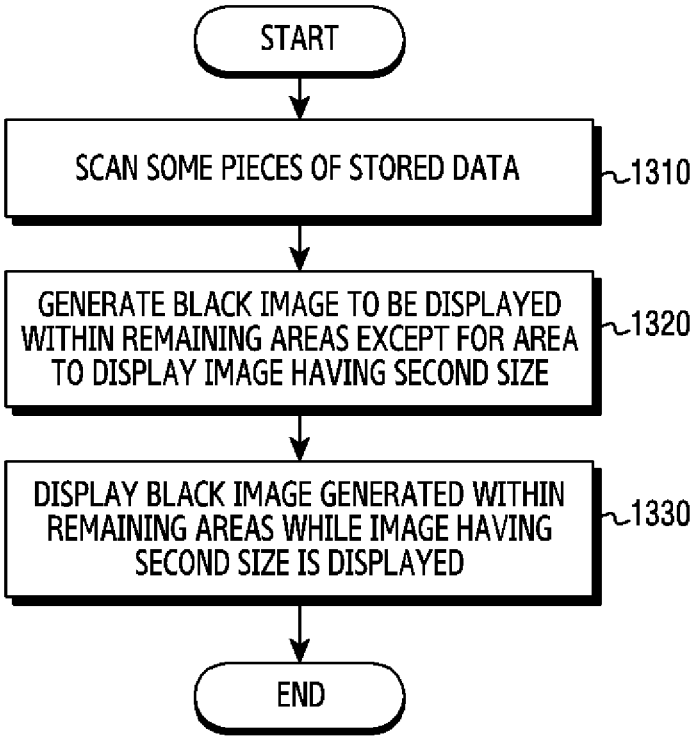
FIG. 13 is a flowchart illustrating a method of generating a black image based on a change in a size of a displayable area of a deformable display panel according to an embodiment of the disclosure.

FIG. 13 is a flowchart illustrating a method of generating a black image based on a change in a size of a displayable area of a deformable display panel according to an embodiment of the disclosure. The method may be performed by the electronic device 101 illustrated in FIG. 1, the electronic device 300 illustrated in FIG. 3, the display driver IC 230 of the display device 160 included in the electronic device 101, or the display driving circuit 320 included in the electronic device 300.

Operations 1310 to 1330 of FIG. 13 may be relevant to operations 1040 and 1050 of FIG. 10.

Referring to FIG. 13, in operation 1310, the display driving circuit 320 may scan some pieces of the data stored in the internal memory 324. For example, operation 1310 may correspond to operation 1040.

In operation 1320, the display driving circuit 320 may generate a black image to be displayed within the remaining areas except for an area to display the image having the second size based on the scanning. For example, the display driving circuit 320 may identify the remaining areas except for the area to display the image having the second size among the entire area of the deformable display panel 330. In various embodiments of the disclosure, the identification may be performed based on the signal received from the sensor 340 or performed based on a result of the scanning.

In operation 1330, the display driving circuit 320 may display the generated black image within the remaining areas while the image having the second size is displayed. FIG. 13 describes that the image having the second size is independent from the black image, but is only for convenience of description. It should be noted that the image having the second size and the black image may be configured by a single image through a combination by the display driving circuit 320.

As described above, the electronic device 300 according to various embodiments may reduce complexity of the operations for changing displaying of the image according to a change in the displayable area by displaying the black image within the remaining areas except for the area for providing information within the displayable area.

Figure 14:
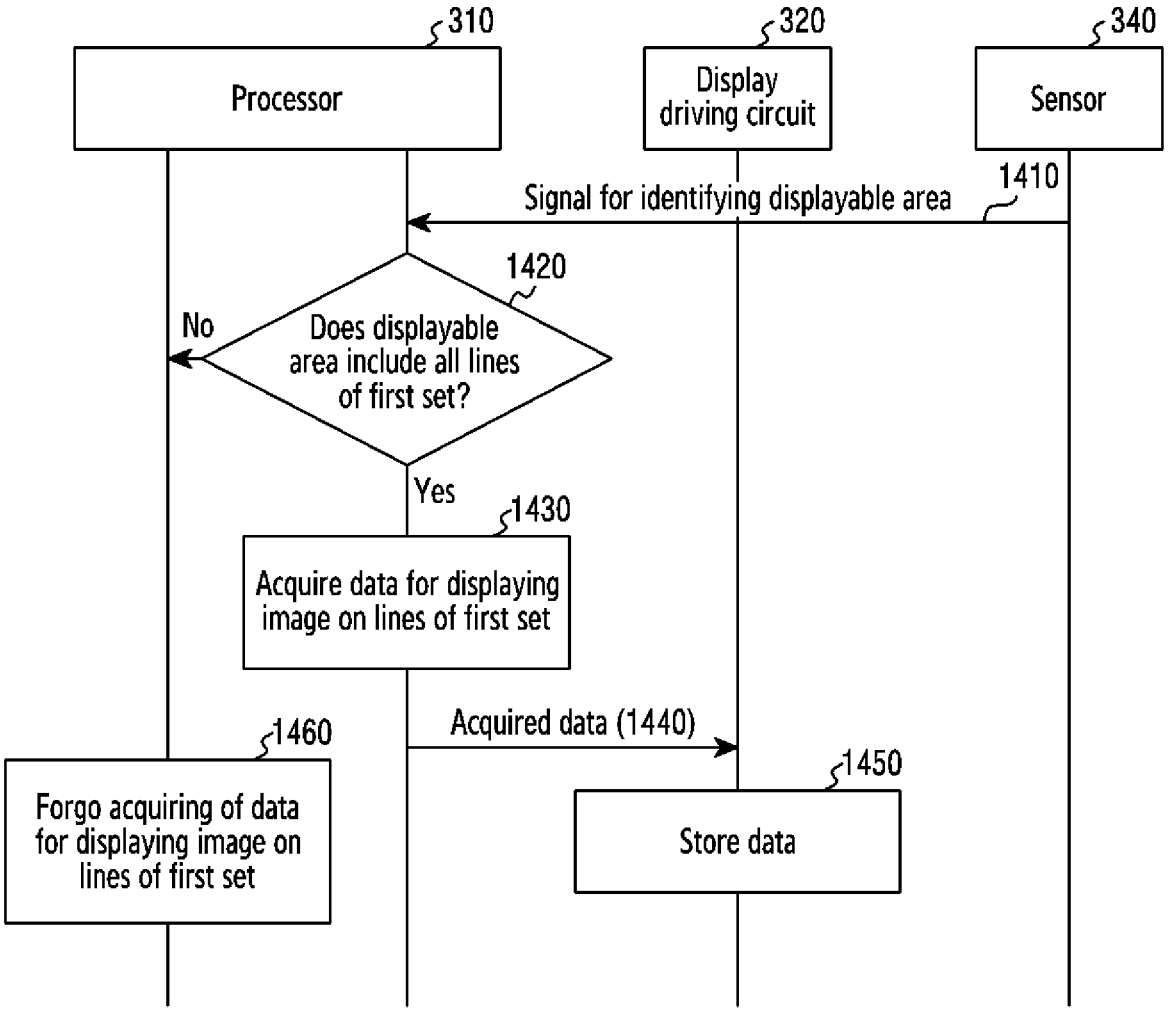
FIG. 14 is a flowchart illustrating a method of acquiring data for displaying an image on lines in a set, based on identification that a displayable area of a deformable display panel includes all lines in one of the sets obtained by dividing an entire area of the deformable display according to an embodiment of the disclosure.

FIG. 14 is a flowchart illustrating a method of acquiring, based on identification that a displayable area of a deformable display panel includes all lines in one of the sets obtained by dividing an entire area of the deformable display panel, data for displaying an image on the lines in the set according to an embodiment of the disclosure. The method may be performed by the electronic device 101 illustrated in FIG. 1, the electronic device 300 illustrated in FIG. 3, elements included in the electronic device 101, or elements included in the electronic device 300.

Referring to FIG. 14, in operation 1410, the processor 310 may receive a signal for identifying the displayable area within the entire area of the deformable display panel 330 from the sensor 340.

In operation 1420, the processor 310 may identify whether the displayable area includes all the lines of a first set among the plurality of lines included in the entire area. For example, the processor 310 may analyze the signal in order to identify whether the displayable area includes all the lines of the first set among the plurality of lines included in the entire area. For example, when the signal includes data indicating a start address and an end address of the displayable area, the processor 310 may identify whether the displayable area includes all the lines of the first set or some of the lines of the first set based on the start address and the end address.

When the signal indicates that the displayable area includes all the lines of the first set, the processor 310 may perform operation 1430. When the signal indicates that the displayable area includes some of the lines of the first set, the processor 310 may perform operation 1460.

In operation 1430, the processor 310 may acquire data for displaying the image on the lines of the first set in response to identification that the displayable area includes all the lines of the first set based on the signal.

In operation 1440, the processor 310 may transmit the data to the display driving circuit 320 in order to record the acquired data in the internal memory 324. The display driving circuit 320 may receive the data from the processor 310.

In operation 1450, the display driving circuit 320 may store the data in the internal memory 324. Although not illustrated in FIG. 14, the display driving circuit 320 may display the image on the lines of the first set by scanning the data.

In operation 1460, the processor 310 may forgo acquiring of the data for displaying the image on the lines of the first set in response to identification that the displayable area includes some of the lines of the first set based on the signal. For example, the processor 310 may bypass or forgo acquiring of the data in order to limit displaying of the image on the lines of the first set until the displayable area includes all the lines of the first set.

As described above, the electronic device 300 according to various embodiments may enhance resource efficiency and reduce complexity by dividing the entire area of the deformable display panel 330 into sets and controlling displaying of the image of the deformable display panel 330 based on the divided sets.

Figure 15:
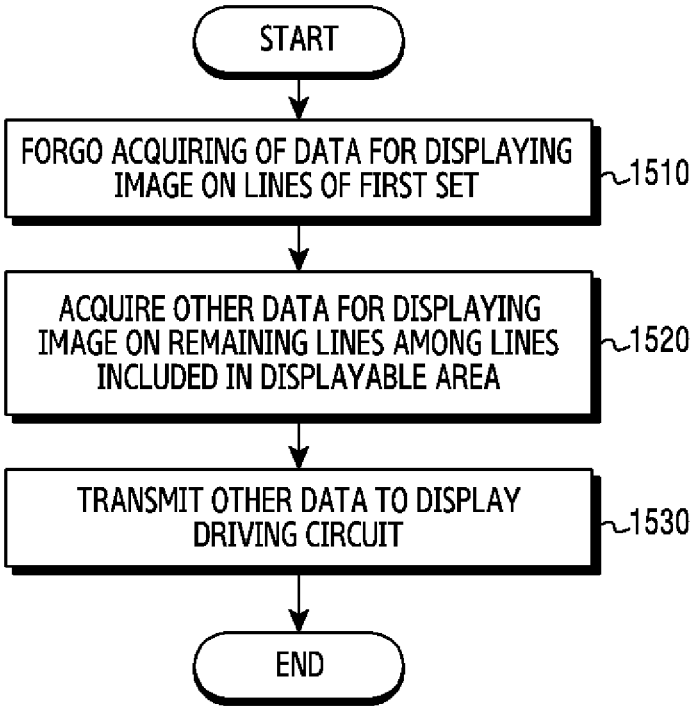
FIG. 15 is a flowchart illustrating a method of processing remaining lines of a displayable area, based on identification that a displayable area of a deformable display panel includes some of lines in one of sets obtained by dividing an entire area of the deformable display panel according to an embodiment of the disclosure.

FIG. 15 is a flowchart illustrating a method of, based on identification that a displayable area of a deformable display panel includes some of lines in one of the sets obtained by dividing an entire area of the deformable display panel, processing the remaining lines of the displayable area according to an embodiment of the disclosure. The method may be performed by the electronic device 101 illustrated in FIG. 1, the electronic device 300 illustrated in FIG. 3, the processor 120 included in the electronic device 101, or the processor 310 included in the electronic device 300.

Operations 1510 to 1530 of FIG. 15 may be relevant to operation 1460 of FIG. 14.

Referring to FIG. 15, in operation 1510, the processor 310 may forgo acquiring data for displaying the image on the lines of the first set. For example, operation 1510 may correspond to operation 1460.

In operation 1520, the processor 310 may acquire other data for displaying the image on the remaining lines except for the lines of the first set among the lines included in the displayable area. For example, when all the lines in the set are included in the displayable area, the processor 310 illustrated in FIGS. 14 and 15 is configured to generate the image to be displayed on the lines, and thus the remaining lines may be all the lines included in at least one other set different from the first set.

In operation 1530, the processor 310 may transmit the other data to the display driving circuit 320 in order to store the other data in the internal memory 324. The display driving circuit 320 may receive the other data from the processor 310 and store the other received data in the internal memory 324. The display driving circuit 320 may scan the other stored data to limit displaying of the image on the lines of the first set within the displayable area and display the image on the remaining lines within the displayable area.

Figure 16:
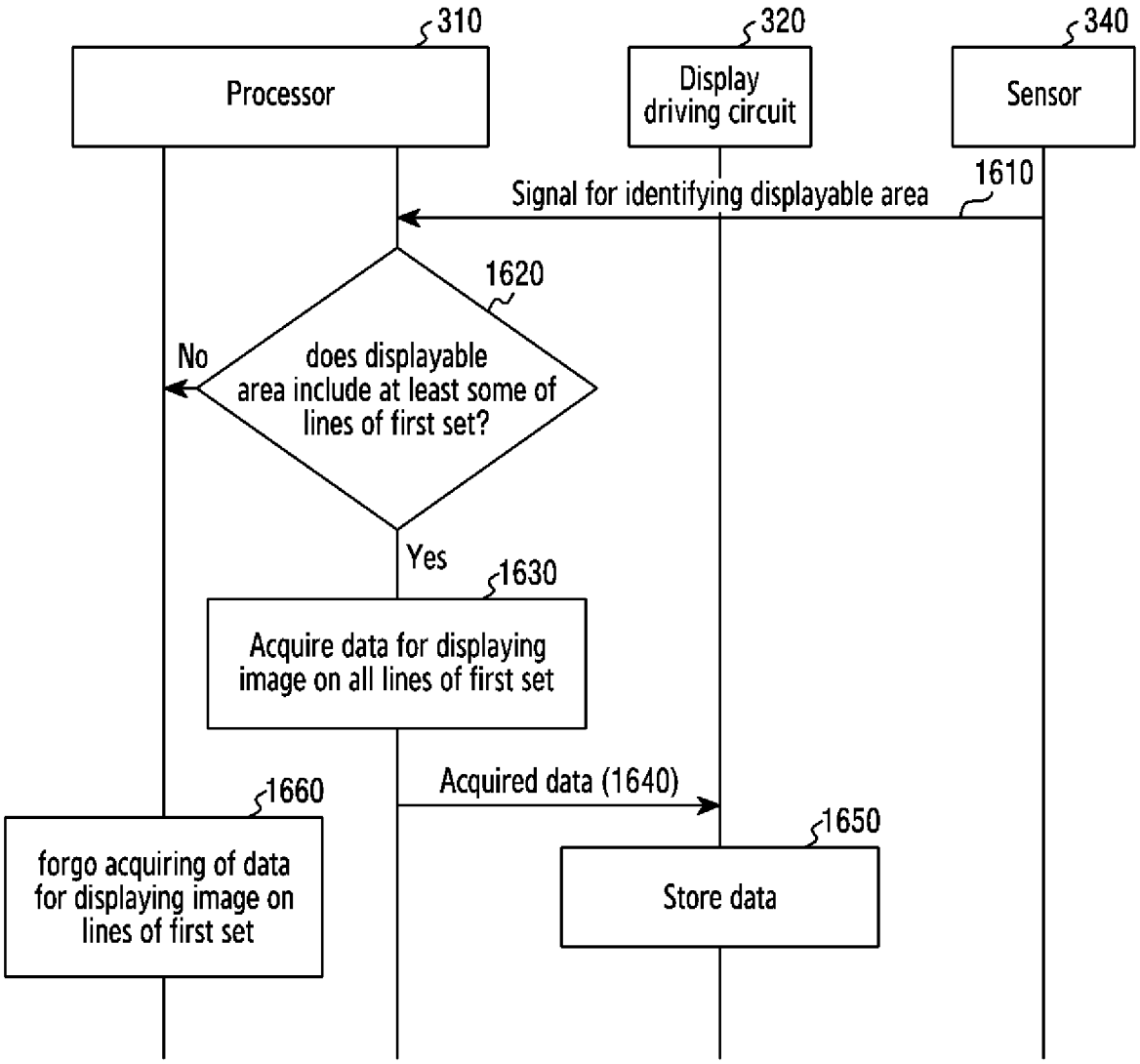
FIG. 16 is a flowchart illustrating a method of acquiring data for displaying an image on lines in a set, based on identification that a displayable area of a deformable display panel includes all lines in one of the sets obtained by dividing an entire area of the deformable display panel according to an embodiment of the disclosure.

FIG. 16 is a flowchart illustrating a method of acquiring, based on identification that a displayable area of a deformable display panel includes some of lines in one of the sets obtained by dividing an entire area of the deformable display panel, data for displaying an image on the lines in the set according to an embodiment of the disclosure. The method may be performed by the electronic device 101 illustrated in FIG. 1, the electronic device 300 illustrated in FIG. 3, elements included in the electronic device 101, or elements included in the electronic device 300.

Referring to FIG. 16, in operation 1610, the processor 310 may receive a signal for identifying a displayable area within an entire area of the deformable display panel 330 from the sensor 340.

In operation 1620, the processor 310 may identify whether the displayable area includes at least some lines of the first set among a plurality of lines included in the entire area based on the signal. For example, the processor 310 may analyze the signal in order to identify whether the displayable area includes at least some of the lines of the first set among the plurality of sets included in the entire area. For example, when the signal includes data indicating a start address and an end address of the displayable area, the processor 310 may identify whether the displayable area includes at least some of the lines of the first set or does not include all the lines of the first set based on the start address and the end address.

The processor 310 may perform operation 1630 when the signal indicates that the displayable area includes at least some of the lines of the first set. The processor 310 may perform operation 1660 when the signal indicates that the displayable area does not include all the lines of the first set.

In operation 1630, the processor 310 may acquire data for displaying the image on all the lines of the first set in response to identification that the displayable area includes at least some of the lines of the first set based on the signal.

In operation 1640, the processor 310 may transmit the data to the display driving circuit 320 in order to record the acquired data in the internal memory 324. The display driving circuit 320 may receive the data from the processor 310.

In operation 1650, the processor 310 may store the data in the internal memory 324. Although not illustrated in FIG. 16, the display driving circuit 320 may display the image on all the lines of the first set by scanning the data even though the displayable area does not include some of the lines of the first set.

In operation 1660, the processor 310 may forgo acquiring of the data for displaying the image on the lines of the first set in response to identification that the displayable area does not include all the lines of the first set based on the signal.

As described above, the electronic device 300 according to various embodiments may enhance resource efficiency and reduce complexity by dividing the entire area of the deformable display panel 330 into sets and controlling displaying of the image of the deformable display panel 330 based on the divided sets. Even though the displayable area includes some of the lines of the first set among the plurality of sets included in the entire area, the electronic device 300 according to various embodiments may acquire data for displaying the image on all the lines of the first set, thereby displaying the image without delay even if the size of the displayable area is rapidly changed.

Methods disclosed in the claims and/or methods according to various embodiments described in the specification of the disclosure may be implemented by hardware, software, or a combination of hardware and software.

When the methods are implemented by software, a computer-readable storage medium for storing one or more programs (software modules) may be provided. The one or more programs stored in the computer-readable storage medium may be configured for execution by one or more processors within the electronic device. The at least one program may include instructions that cause the electronic device to perform the methods according to various embodiments of the disclosure as defined by the appended claims and/or disclosed herein.

The programs (software modules or software) may be stored in non-volatile memories including a random access memory and a flash memory, a read only memory (ROM), an electrically erasable programmable read only memory (EEPROM), a magnetic disc storage device, a compact disc-ROM (CD-ROM), digital versatile discs (DVDs), or other type optical storage devices, or a magnetic cassette. Alternatively, any combination of some or all of them may form a memory in which the program is stored. Further, a plurality of such memories may be included in the electronic device.

In addition, the programs may be stored in an attachable storage device which may access the electronic device through communication networks, such as the Internet, Intranet, local area network (LAN), wide LAN (WLAN), and storage area network (SAN) or a combination thereof. Such a storage device may access the electronic device via an external port. Further, a separate storage device on the communication network may access a portable electronic device.

In the above-described embodiments of the disclosure, an element included in the disclosure is expressed in the singular or the plural according to presented embodiments. However, the singular form or plural form is selected appropriately to the presented situation for the convenience of description, and the disclosure is not limited by elements expressed in the singular or the plural. Therefore, either an element expressed in the plural may also include a single element or an element expressed in the singular may also include multiple elements.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a deformable display panel;

a sensor;

a display driving circuit operatively connected to the deformable display panel and the sensor and comprising a graphical random access memory, GRAM; and a processor operatively connected to the display driving circuit and the sensor, wherein the processor is configured to, while a size of a displayable area of the deformable display panel is changed:

receive a signal indicating that the size of the displayable area is a third size smaller than a first size from the sensor, generate data for displaying an image having the first size obtained by adding a fourth size for a margin area to the third size in response to reception of the signal, and transmit the data for displaying the image having the first size to the display driving circuit, and wherein the display driving circuit is configured to:

store the data for displaying the image having the first size received from the processor in the GRAM while the size of the displayable area of the deformable display panel is changed, receive another signal indicating that the size of the displayable area is a second size smaller than the first size after storing the data, and in response to reception of the other signal, display the image having the second size through the deformable display panel by scanning some pieces of the data which are corresponding to the second size and forgoing scanning of some pieces of the remaining data.

2. The electronic device of claim 1, wherein the processor is further configured to, while the size of the displayable area is changed:

receive the signal from the sensor using a framework installed in the electronic device, provide information on the signal to an application executed in the electronic device using the framework, and generate the data for displaying the image having the first size obtained by adding the fourth size for the margin area to the third size, using the application, based on the information on the signal.

3. The electronic device of claim 1, wherein the processor is further configured to, while the size of the displayable area of the deformable display panel:

determine the fourth size, based on a speed at which the size of the displayable area is changed, in response to reception of the signal, and generate the data for displaying the image having the first size obtained by adding the fourth size to the third size.

4. The electronic device of claim 3, wherein the margin area is at least a portion of the remaining areas except for the displayable area having the third size within an entire area of the deformable display panel.

5. The electronic device of claim 1, wherein the display driving circuit is further configured to deactivate the remaining areas of an entire area of the deformable display panel except for an area in which the image having the second size is displayed while the image having the second size is displayed through the deformable display panel.

6. The electronic device of claim 1, wherein the display driving circuit is further configured to display a black image in the remaining area of an entire area of the deformable display panel except for an area in which the image having the second size is displayed while the image having the second size is displayed through the deformable display panel.

7. The electronic device of claim 1, wherein the other signal comprises data indicating a start address of the displayable area having the second size and data indicating an end address of the displayable area having the second size.

8. The electronic device of claim 1, wherein the other signal comprises data indicating a height of the displayable area having the second size and data indicating a width of the displayable area having the second size.

9. The electronic device of claim 8, wherein the other signal further comprises data indicating a start address of the displayable area.

10. The electronic device of claim 1, wherein the other signal comprises data indicating a start address of scanning of some pieces of the data and data indicating an end address of scanning of some pieces of the data among a plurality of addresses configured in the GRAM.

11. The electronic device of claim 1, wherein the data is provided from the display driving circuit to the processor and is transmitted from the processor to the display driving circuit, based on a Tearing Effect (TE) signal for controlling a timing at which the data is stored in the GRAM, and wherein the display driving circuit is configured to receive the signal from the sensor at a timing at which a vertical synchronization signal for controlling a timing at which the image is displayed through the deformable display panel is acquired or within a porch internal of the vertical synchronization signal.

12. The electronic device of claim 1, wherein the deformable display panel comprises a rollable display panel, an extendable display panel, a flexible display panel, or a foldable display panel, and wherein the sensor comprises an angle measurement sensor, an accelerator sensor, a gyro sensor, a proximity sensor, a magnetic sensor, or a combination thereof.

* * * * *